US009520094B2

(12) United States Patent
Harada et al.

(10) Patent No.: US 9,520,094 B2
(45) Date of Patent: Dec. 13, 2016

(54) DISPLAY DEVICE, ELECTRONIC APPARATUS, AND METHOD FOR DRIVING DISPLAY DEVICE

(71) Applicant: Japan Display Inc., Tokyo (JP)

(72) Inventors: Tsutomu Harada, Tokyo (JP); Naoyuki Takasaki, Tokyo (JP); Susumu Kimura, Tokyo (JP); Yasuhisa Shiraishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 157 days.

(21) Appl. No.: 14/519,755

(22) Filed: Oct. 21, 2014

(65) Prior Publication Data

US 2015/0109351 A1 Apr. 23, 2015

(30) Foreign Application Priority Data

Oct. 22, 2013 (JP) ..... 2013-219701
Oct. 22, 2013 (JP) ..... 2013-219702
Apr. 2, 2014 (JP) ..... 2014-076453

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01)

(58) Field of Classification Search
CPC ..... G09G 3/3607; G09G 3/34–3/3426
USPC ..... 345/102
See application file for complete search history.

(56) References Cited

U.S. PATENT DOCUMENTS 8,334,884 B2 12/2012 Kato
8,624,943 B2 1/2014 Noguchi et al.
8,848,004 B2 9/2014 Kato
2007/0091043 A1* 4/2007 Rho ..... G02F 1/133514 345/88
2009/0091805 A1* 4/2009 Tanabe ..... B41J 2/473 358/475
2010/0013750 A1* 1/2010 Kerofsky ..... G09G 3/006 345/89
2010/0253696 A1* 10/2010 Choi ..... G09G 3/3426 345/589

FOREIGN PATENT DOCUMENTS

JP 2000-321993 11/2000
JP 2000-321993 A 11/2000
(Continued)

*Primary Examiner* — Stephen Sherman
(74) *Attorney, Agent, or Firm* — Michael Best & Friedrich LLP

(57) ABSTRACT

According to an aspect, a display device includes: an image display panel; and a planar light source including a light guide plate and an edge-lit light source, the light guide plate illuminating the image display panel from a back side, the edge-lit light source including a plurality of light sources arranged facing a plane of incidence; and a controller that controls luminance of each of the light sources independently. The controller stores therein, as lookup tables for the respective light sources, information on light intensity distributions of light that is incident on the light guide plate from the respective light sources and is emitted to a plane of the image display panel from the light guide plate, and controls a light quantity of each of the light sources based on information on an input signal of an image, and on the lookup tables.

19 Claims, 27 Drawing Sheets

(56) References Cited

FOREIGN PATENT DOCUMENTS

| | | | |
|---|---|---|---|
| JP | 2010-033014 | A | 2/2010 |
| JP | 2010-127994 | | 6/2010 |
| JP | 2010-127994 | A | 6/2010 |

* cited by examiner

LINEAR
INTERPOLATION

POLYNOMIAL
INTERPOLATION

DISPLAY DEVICE, ELECTRONIC APPARATUS, AND METHOD FOR DRIVING DISPLAY DEVICE

CROSS-REFERENCE TO RELATED APPLICATIONS

This application claims priority from Japanese Application No. 2013-219701, filed on Oct. 22, 2013, Japanese Application No. 2013-219702, filed on Oct. 22, 2013, and Japanese Application No. 2014-076453, filed on Apr. 2, 2014, the contents of which are incorporated by reference herein in its entirety.

BACKGROUND

1. Technical Field

The present disclosure relates to a display device, an electronic apparatus, and a method for driving a display device.

2. Description of the Related Art

In recent years, a demand for display devices for use in, for example, mobile devices such as a mobile phone and electronic paper has increased. In a display device, one pixel includes a plurality of sub-pixels, each of which emits light of a different color. The single pixel displays various colors by switching on and off display of the sub-pixels. Such display devices have been improved year after year in display properties such as resolution and luminance. However, an increase in the resolution reduces an aperture ratio, and thus increases necessity for an increase in luminance of a backlight to achieve high luminance, which causes a problem of an increase in power consumption of the backlight. To address the problem, there is a technique (such as Japanese Patent Application Laid-open Publication No. 2010-33014) in which a white pixel as a fourth sub-pixel is added to the conventional sub-pixels of red, green, and blue. This technique reduces the current value of the backlight because the luminance is increased by the white pixel, and thereby reduces the power consumption.

Japanese Patent Application Laid-open No. 2000-321993 (JP-A-2000-321993) discloses a technology for preventing blur in moving an image by using a liquid crystal display panel including a plurality of fluorescent tubes on the rear side of the liquid crystal display panel. In this technology, after video data is written to a pixel row in the liquid crystal display panel, the fluorescent tube provided at a position corresponding to the pixel row to which the video data is written is illuminated and the video image is displayed after a predetermined time elapses.

When the technology disclosed in JP-A-2000-321993 is used in an edge-lit light source including a plurality of light sources aligned at positions facing a plane of incidence that is at least one side of the light guide plate, the luminance distribution of the backlight changes complexly, so that a large amount of computations is required.

When the technology disclosed in Japanese Patent Application Laid-open No. 2010-127994 is used in an edge-lit light source that includes a plurality of light sources aligned at a position facing a plane of incidence that is at least one side of the light guide plate, and in which each of the light sources is controlled independently, the luminance distribution of the backlight changes complexly. Therefore, this technology cannot be used in the edge-lit light source.

For the foregoing reasons, there is a need for a display device, an electronic apparatus, and a method for driving a display device that can be applied to an edge-lit light source in which each of the light sources is controlled independently.

SUMMARY

According to an aspect, a display device includes: an image display panel; and a planar light source including a light guide plate and an edge-lit light source, the light guide plate illuminating the image display panel from a back side, the edge-lit light source including a plurality of light sources arranged facing a plane of incidence that is at least one side surface of the light guide plate; and a controller that controls luminance of each of the light sources independently. The controller stores therein, as lookup tables for the respective light sources, information on light intensity distributions of light that is incident on the light guide plate from the respective light sources and is emitted to a plane of the image display panel from the light guide plate, and controls a light quantity of each of the light sources based on information on an input signal of an image, and on the lookup tables.

According to another aspect, a method for driving a display device that includes an image display panel and a planar light source including a light guide plate and an edge-lit light source, the light guide plate illuminating the image display panel from a back side, the edge-lit light source including a plurality of light sources arranged facing a plane of incidence that is at least one side surface of the light guide plate, includes: detecting an input signal of an image; analyzing the image; and computing a light quantity of each of the light sources based on a result of the analyzing the image, and based on lookup tables corresponding to the light sources, the lookup tables storing therein information on light intensity distributions of light that is incident on the light guide plate from the respective light sources and is emitted to a plane of the image display panel from the light guide plate.

According to another aspect, a method for driving a display device that includes an image display panel and a planar light source including a light guide plate and an edge-lit light source, the light guide plate illuminating the image display panel from a back side, the edge-lit light source including a plurality of light sources arranged facing a plane of incidence that is at least one side surface of the light guide plate, includes: detecting an input signal of an image; analyzing the image; computing a light quantity of each of the light sources based on a result of the analyzing the image, and based on corrected lookup tables that correspond to the respective light sources and in which peak components are suppressed, the lookup tables being lookup tables corresponding to the light sources and storing therein information on light intensity distributions of light that is incident on the light guide plate from the respective light sources and is emitted to a plane of the image display panel from the light guide plate, and the peak components being observed when all of the light sources emit light by approximately same quantity.

DETAILED DESCRIPTION

An embodiment for implementing the present disclosure will be described in detail with reference to the accompanying drawings. The embodiment described below is not intended to limit the scope of the present disclosure in any way. The elements described below include those that are substantially the same with those that can be easily thought of by those skilled in the art. The elements described below may also be combined as appropriate.

First Embodiment

Configuration of Display Device

Figure 1:
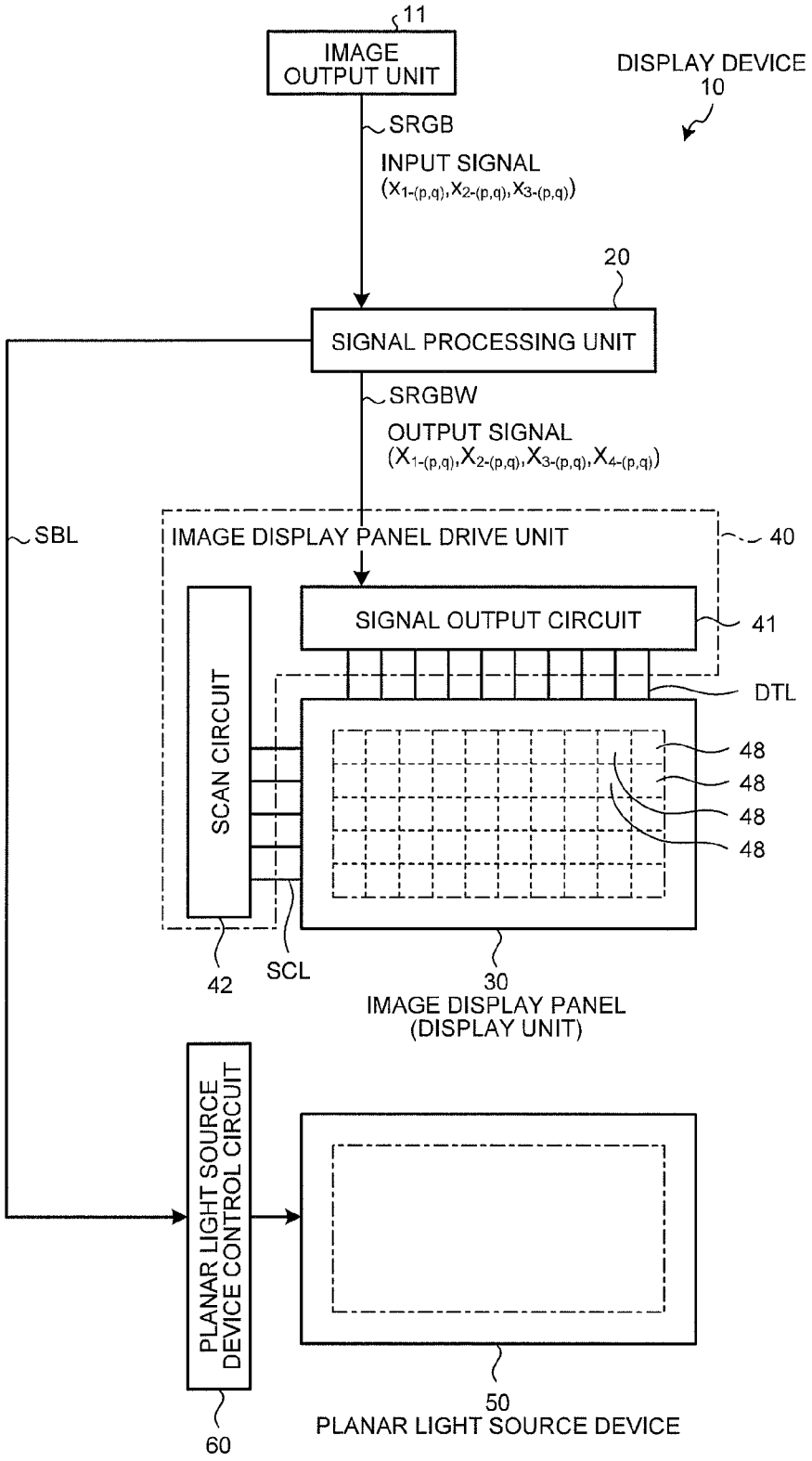
FIG. 1 is a block diagram illustrating an example of a configuration of a display device according to a first embodiment.
Figure 2:
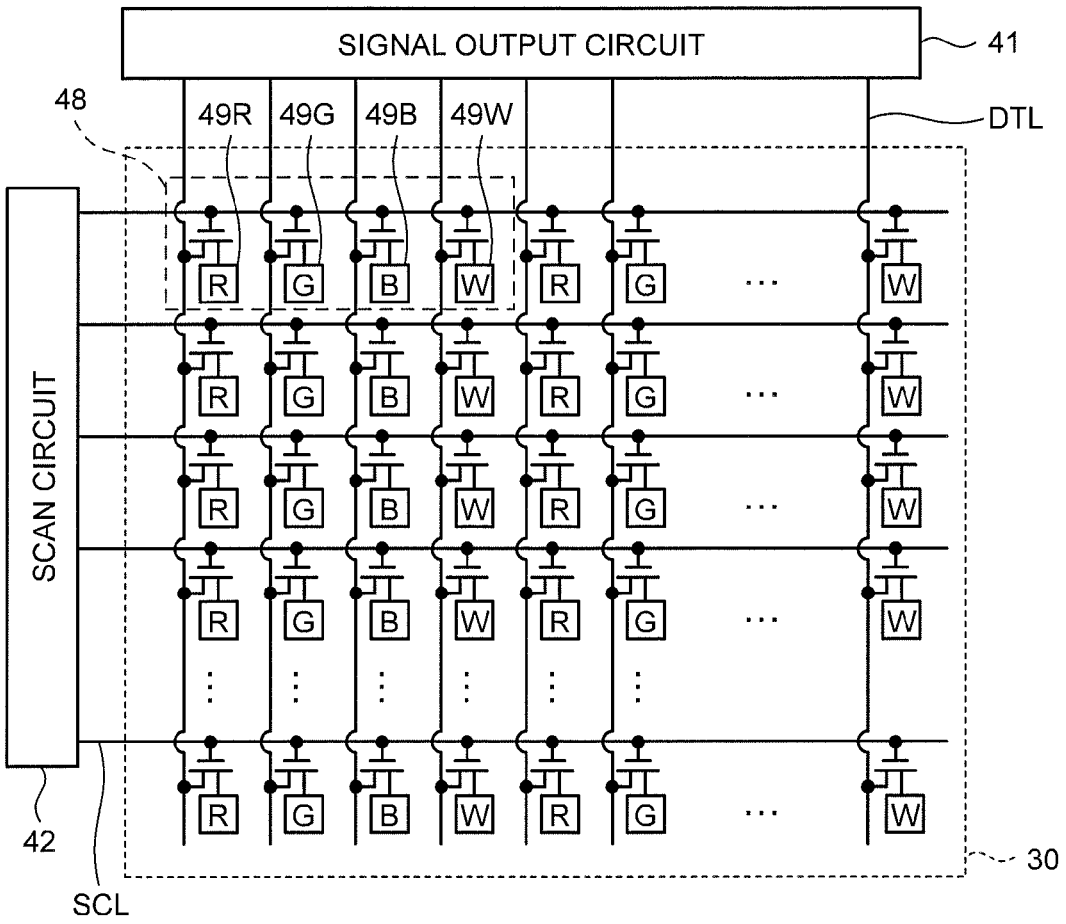
FIG. 2 is a diagram illustrating a pixel array of an image display panel according to the embodiment.

FIG. 1 is a block diagram illustrating an example of a configuration of a display device according to the present embodiment. FIG. 2 is a diagram illustrating a pixel array of an image display panel according to the present embodiment.

As illustrated in FIG. 1, a display device 10 includes a signal processing unit 20, an image display panel (display unit) 30, an image-display-panel-drive-unit 40, a planar-light-source-device 50, and a planar-light-source-device-control-unit 60. The signal processing unit 20 receives an input image signal SRGB from an image output unit 11, and transmits an output signal SRGBW to each unit in the display device 10 to control the operations of each unit. The image display panel 30 displays an image based on the output signal SRGBW received from the signal processing unit 20. The image-display-panel-drive-unit 40 controls driving of the image display panel 30. The planar-light-source-device 50 illuminates the image display panel 30 from the back side. The planar-light-source-device-control-unit 60 controls driving of the planar-light-source-device 50. The display device 10 has the same configuration as that of an image display device assembly described in Japanese Patent Application Laid-open Publication No. 2011-154323

(JP-A-2011-154323), and various modifications described in JP-A-2011-154323 are applicable thereto.

The signal processing unit 20 is an arithmetic processing unit that controls the operations of the image display panel 30 and the planar-light-source-device 50. The signal processing unit 20 is coupled to the image-display-panel-drive-unit 40 for driving the image display panel 30 and to the planar-light-source-device-control-unit 60 for driving the planar-light-source-device 50. The signal processing unit 20 processes an externally supplied input signal, and generates output signals and a planar-light-source-device-control-signal. In other words, the signal processing unit 20 generates the output signals by converting input values (input signals) in an input HSV color space of the input signal into extended values (output signals) in an extended HSV color space extended with four colors of a first color, a second color, a third color, and a fourth color, and outputs the generated output signals to the image display panel 30. The signal processing unit 20 outputs the generated output signals to the image-display-panel-drive-unit 40 and the generated planar-light-source-device-control-signal to the planar-light-source-device-control-unit 60.

As illustrated in FIG. 1, pixels 48 are arranged on the image display panel 30 in a two-dimensional matrix of $P_0 \times Q_0$ pixels ($P_0$ pixels in the row direction and $Q_0$ pixels in the column direction). The example illustrated in FIG. 1 illustrates an example in which the pixels 48 are arranged in a matrix-like manner in a two-dimensional coordinate system of X and Y. In this example, the row direction corresponds to the X-direction, and the column direction corresponds to the Y-direction.

The pixels 48 include first sub-pixels 49R, second sub-pixels 49G, third sub-pixels 49B, and fourth sub-pixels 49W. The first sub-pixels 49R display a first primary color (such as red). The second sub-pixels 49G display a second primary color (such as green). The third sub-pixels 49B display a third primary color (such as blue). The fourth sub-pixels 49W display a fourth color (specifically, white). In this manner, each of the pixels 48 arranged in a matrix on the image display panel 30 has a first sub-pixel 49R for displaying the first color, a second sub-pixel 49G for displaying the second color, a third sub-pixel 49B for displaying the third color, and a fourth sub-pixel 49W for displaying the fourth color. The first color, the second color, the third color, and the fourth color are not limited to the first primary color, the second primary color, the third primary color, and the white color, but may be any different colors, e.g., complementary colors. The fourth sub-pixel 49W for displaying the fourth color is preferably brighter, when illuminated with the same light quantity, than the first sub-pixel 49R for displaying the first color, the second sub-pixel 49G for displaying the second color, and the third sub-pixel 49B for displaying the third color. Hereinafter, the sub-pixels will be collectively called sub-pixels 49 when the first sub-pixels 49R, the second sub-pixels 49G, the third sub-pixels 49B, and the fourth sub-pixels 49W need not be distinguished from each other.

More specifically, the display device 10 is a transmissive color liquid crystal display device. As illustrated in FIG. 2, the image display panel 30 is a color liquid crystal display panel. In the image display panel, a first color filter through which the first primary color passes is disposed between a first sub-pixel 49R and an image observer, and a second color filter through which the second primary color passes is disposed between a second sub-pixel 49G and the image observer, and a third color filter through which the third primary color passes is disposed between a third sub-pixel 49B and the image observer. The image display panel 30 has no color filter disposed between a fourth sub-pixel 49W and the image observer. The fourth sub-pixel 49W may be provided with a transparent resin layer instead of the color filter. Providing the fourth sub-pixel 49W with the transparent resin layer allows the image display panel 30 to keep a large difference in level from occurring at the fourth sub-pixel 49W caused by not providing the fourth sub-pixel 49W with the color filter.

The image-display-panel-drive-unit 40 illustrated in FIGS. 1 and 2 is included in a controller according to the present embodiment, and includes a signal output circuit 41 and a scan circuit 42. The image-display-panel-drive-unit 40 uses the signal output circuit 41 to hold and sequentially output video signals to the image display panel 30. The signal output circuit 41 is electrically coupled to the image display panel 30 via signal lines DTL. The image-display-panel-drive-unit 40 uses the scan circuit 42 to select the sub-pixels 49 on the image display panel 30, and controls on and off of switching elements (such as thin film transistors [TFTs]) for controlling operations (optical transmittance) of the sub-pixels 49. The scan circuit 42 is electrically coupled to the image display panel 30 via scan lines SCL.

Figure 3:
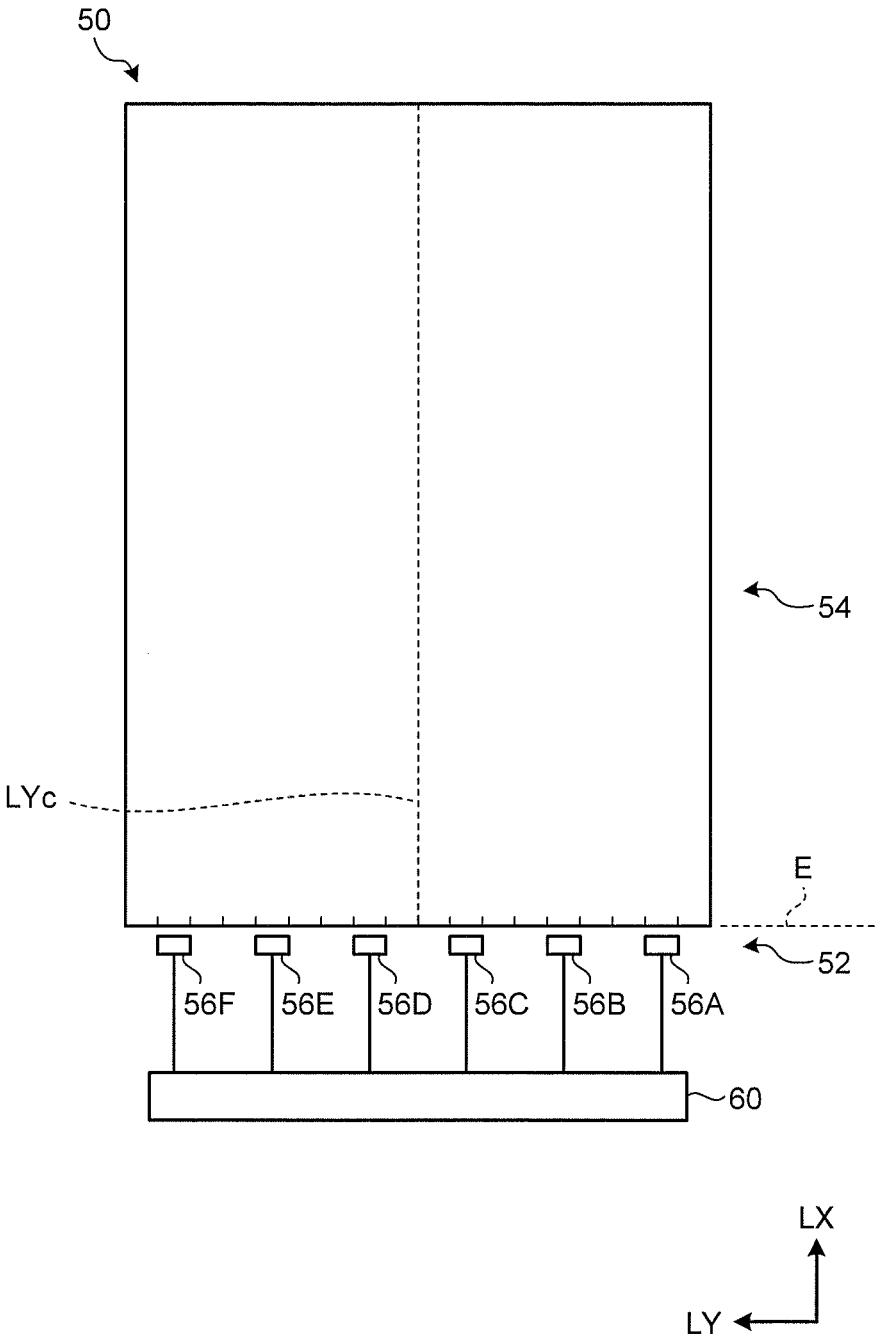
FIG. 3 is an explanatory diagram for explaining a light guide plate and an edge-lit light source according to the first and second embodiments.

The planar-light-source-device 50 is disposed on the back side of the image display panel 30, and emits light to the image display panel 30 to illuminate the image display panel 30. FIG. 3 is an explanatory diagram for explaining a light guide plate and an edge-lit light source according to the present embodiment. The planar-light-source-device 50 includes a light guide plate 54 and an edge-lit light source 52. The edge-lit light source 52 includes a plurality of light sources 56A, 56B, 56C, 56D, 56E, and 56F aligned at a position facing a plane of incidence E that is at least one side surface of the light guide plate 54. The light sources 56A, 56B, 56C, 56D, 56E, and 56F are light emitting diodes (LEDs) of the same color (e.g., white), for example. The light sources 56A, 56B, 56C, 56D, 56E, and 56F are aligned along one side surface of the light guide plate 54. When LY denotes a light-source-arrangement-direction that is the direction along which the light sources 56A, 56B, 56C, 56D, 56E, and 56F are aligned, the light becomes incident on the plane of incidence E of the light guide plate 54 from the light sources 56A, 56B, 56C, 56D, 56E, and 56F in an incidence direction LX that is perpendicular to the light-source-arrangement-direction LY. LYc denotes the center line of the light guide plate 54 in the light-source-arrangement-direction LY.

The planar-light-source-device-control-unit 60 controls, for example, a quantity of the light emitted from the planar-light-source-device 50. The planar-light-source-device-control-unit 60 is included in the controller according to the present embodiment. Specifically, the planar-light-source-device-control-unit 60 adjusts the current to be supplied to or the duty ratio of the voltage or the current for the planar-light-source-device 50 based on a planar-light-source-device-control-signal SBL received from the signal processing unit 20, thereby controlling the quantity (intensity) of the light which illuminates the image display panel 30. In other words, the planar-light-source-device-control-unit 60 can control the current to be supplied to or the duty ratio of the voltage or the current for each of the light sources 56A, 56B, 56C, 56D, 56E, and 56F, illustrated in FIG. 3, independently, thereby controlling the quantity (intensity) of light emitted from each of the light sources 56A, 56B, 56C, 56D, 56E, and 56F independently.

Figure 4:
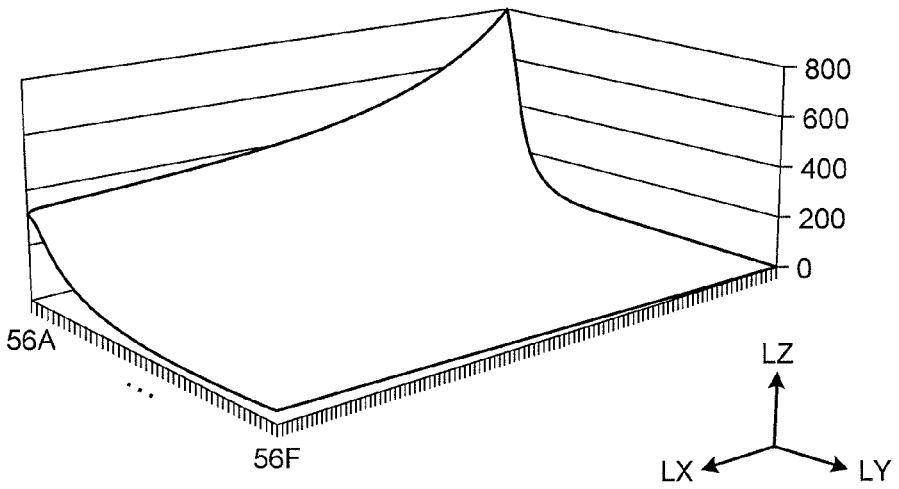
FIG. 4 is an explanatory diagram for explaining an example of a light intensity distribution affected by one of light sources in the edge-lit light source according to the first embodiment.
Figure 5:
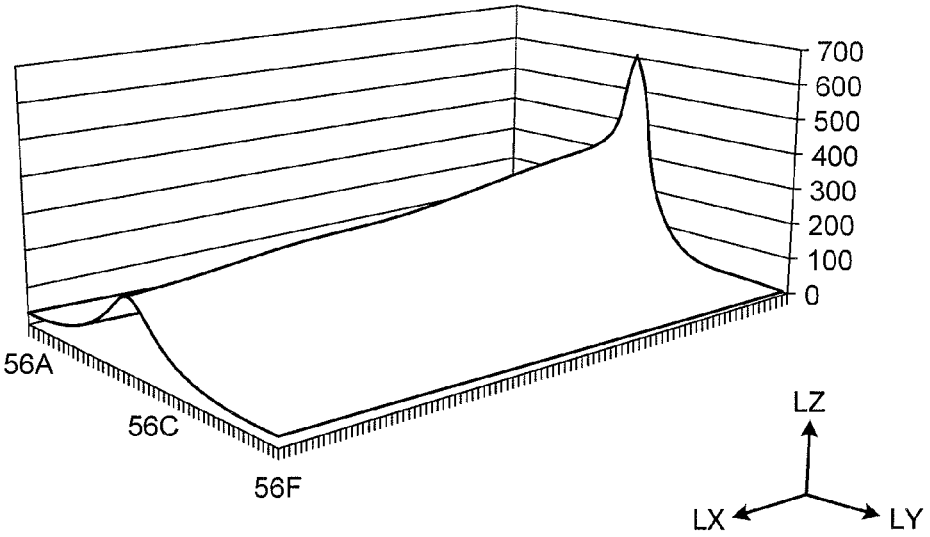
FIG. 5 is an explanatory diagram for explaining an example of a light intensity distribution affected by another one of the light sources in the edge-lit light source according to the first embodiment.

FIGS. 4 and 5 are explanatory diagrams for explaining examples of a light intensity distribution of one of the light sources provided to the edge-lit light source according to the present embodiment. FIG. 4 illustrates information on a light intensity distribution obtained when the light incident on the light guide plate 54 from the light source 56A is emitted to the plane of the image display panel 30 from the light guide plate 54 in a case where only the light source 56A emits light. When the light from the light source 56A becomes incident on the plane of incidence E of the light guide plate 54 along the incidence direction LX that is perpendicular to the light-source-arrangement-direction LY, the light guide plate 54 illuminates the image display panel 30 from the back side in an illumination direction LZ. In the present embodiment, the illumination direction LZ is perpendicular to the light-source-arrangement-direction LY and the incidence direction LX.

FIG. 5 represents information on a light intensity distribution obtained when the light incident on the light guide plate 54 from the light source 56C is emitted to the plane of the image display panel 30 from the light guide plate 54 in a case where only the light source 56C illustrated in FIG. 3 emits light. When the light from the light source 56C becomes incident on the plane of incidence E of the light guide plate 54 along the incidence direction LX that is perpendicular to the light-source-arrangement-direction LY, the light guide plate 54 illuminates the image display panel 30 from the back side in the illumination direction LZ.

The light intensity distributions of the light emitted from the light source 56A or the light source 56F positioned near the end surfaces of the light guide plate 54 in the light-source-arrangement-direction LY are different from the light intensity distribution of the light emitted from the light source 56C, for example, positioned between the light source 56A and the light source 56F, because the light is reflected on the end surfaces in the light-source-arrangement-direction LY. The planar-light-source-device-control-unit 60 according to the present embodiment, therefore, needs to control the currents to be supplied to or the duty ratios for the respective light sources 56A, 56B, 56C, 56D, 56E, and 56F illustrated in FIG. 3 independently, in the manner to be described later, to control the quantity (intensity) of light to be emitted based on the light intensity distributions of the light emitted from the light sources 56A, 56B, 56C, 56D, 56E, and 56F. A processing operation performed by the display device 10, more specifically, by the signal processing unit 20 will be described below.

Processing Operation of Display Device

Figure 6:
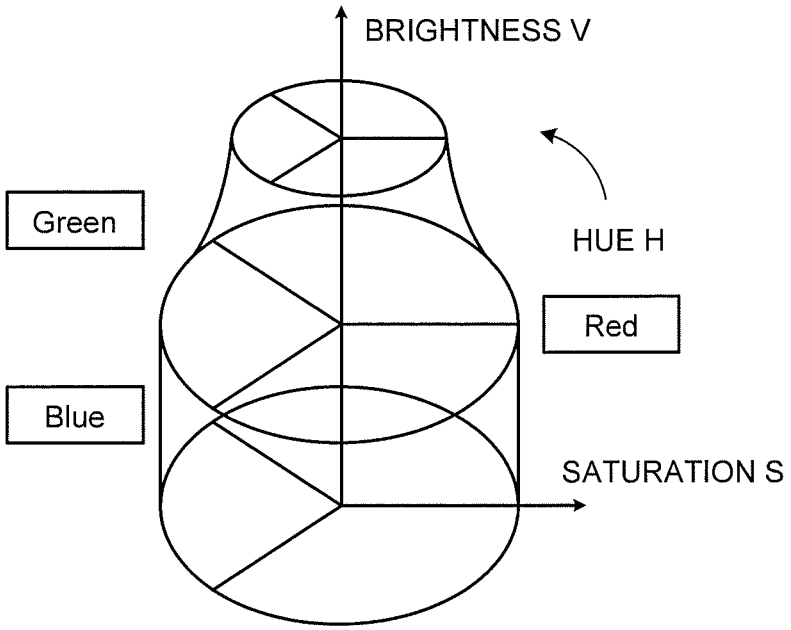
FIG. 6 is a conceptual diagram of an extended HSV color space that is extendable by the display device of the first embodiment.
Figure 7:
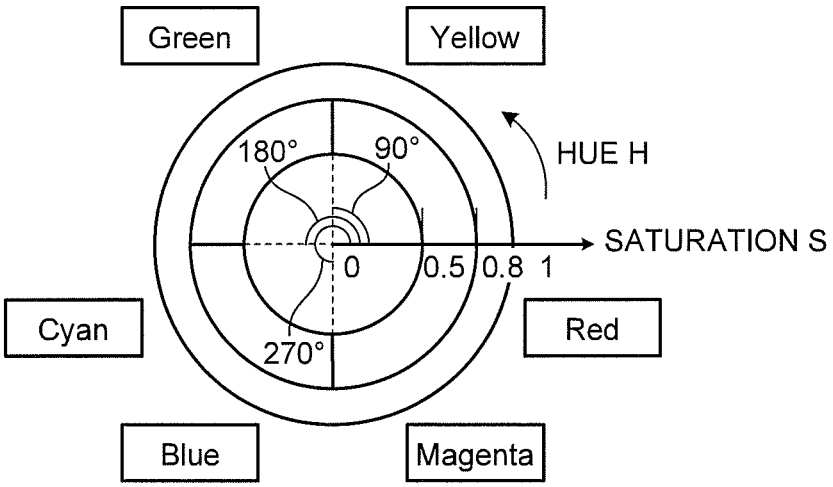
FIG. 7 is a conceptual diagram illustrating a relation between hue and saturation of the extended HSV color space.
Figure 8:
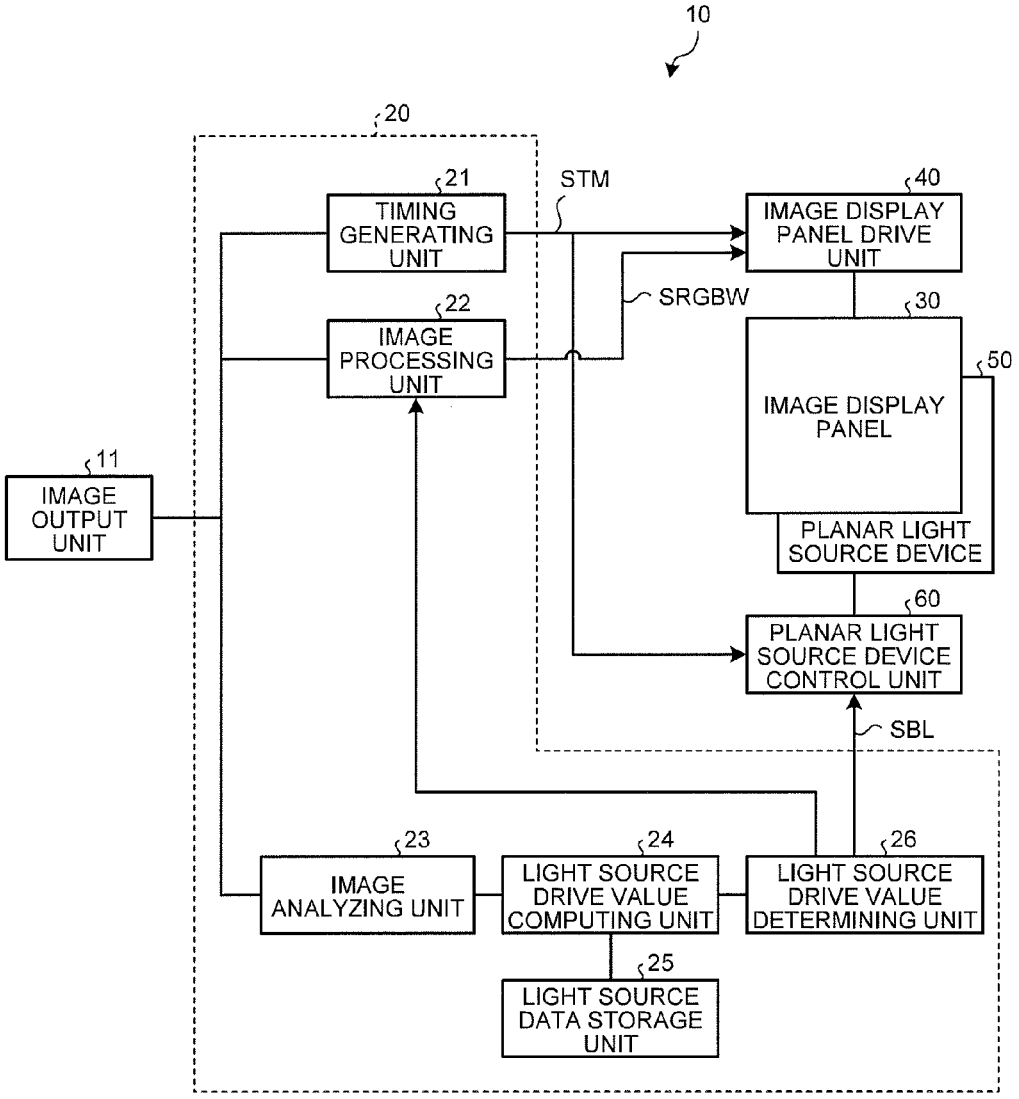
FIG. 8 is a block diagram for explaining a signal processing unit according to the first embodiment.
Figure 9:
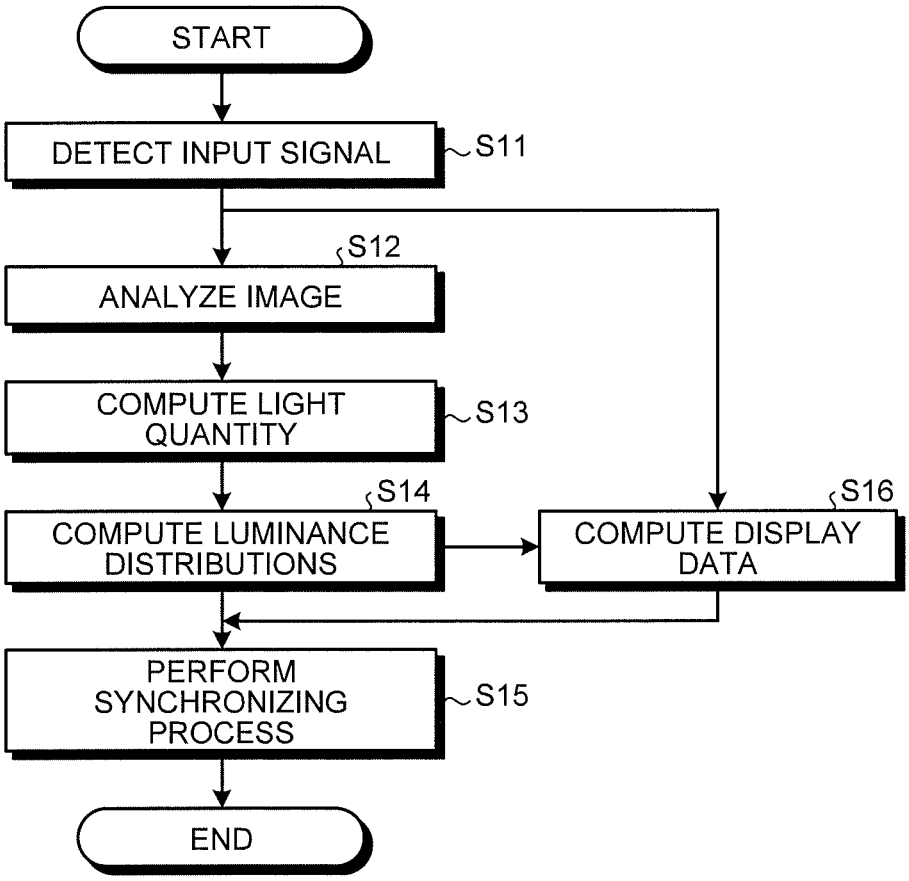
FIG. 9 is a flowchart of a method for driving a display device according to the first embodiment.

FIG. 6 is a conceptual diagram of the extended HSV color space that is extendable by the display device of the present embodiment. FIG. 7 is a conceptual diagram illustrating a relation between hue and saturation of the extended HSV color space. FIG. 8 is a block diagram for explaining a signal processing unit according to the present embodiment. As illustrated in FIG. 1, the signal processing unit 20 receives an input signal SRGB representing the information on an image to be displayed from the external image output unit 11. FIG. 9 is a flowchart of a method for driving a display device according to the present embodiment. The input signal SRGB includes information on images (colors) to be displayed by respective pixels in positions thereof. Specifically, in the image display panel 30 on which $P_0 \times Q_0$ pixels 48 are arranged in a matrix, with respect to the (p, q)th pixel 48 (where $1 \leq p \leq P_0$ and $1 \leq q \leq Q_0$), the signal processing unit 20 receives the signal that includes an input signal for a first sub-pixel 49R having a signal value of $x_{1-(p,\ q)}$, an input signal for a second sub-pixel 49G having a signal value of $x_{2-(p,\ q)}$, and an input signal for a third sub-pixel 49B having a signal value of $x_{3-(p,\ q)}$ (refer to FIG. 1). The signal processing unit 20 includes a timing generating unit 21, an image processing unit 22, an image analyzing unit 23, a light-source-drive-value-computing-unit 24, a light-source-data-storage-unit 25, and a light-source-drive-value-determining-unit 26, as illustrated in FIG. 8.

As illustrated in FIG. 9, the signal processing unit 20 illustrated in FIGS. 1 and 8 detects an input signal SRGB (Step S11). The timing generating unit 21 then processes the input signal SRGB, and sends a synchronizing signal STM for synchronizing the timing of the image-display-panel-drive-unit 40 and the planar-light-source-device-control-unit 60 to the image-display-panel-drive-unit 40 and the planar-light-source-device-control-unit 60 for each frame. The image processing unit 22 of the signal processing unit 20 processes the input signals SRGB to perform the arithmetic step (step S16) to generate an output signal (signal value $X_{1-(p,\ q)}$) for the first sub-pixel for determining the display gradation of the first sub-pixel 49R, an output signal (signal value $X_{2-(p,\ q)}$) for the second sub-pixel for determining the display gradation of the second sub-pixel 49G, an output signal (signal value $X_{3-(p,\ q)}$) for the third sub-pixel for determining the display gradation of the third sub-pixel 49B, and an output signal (signal value $X_{4-(p,\ q)}$) for the fourth sub-pixel for determining the display gradation of a fourth sub-pixel 49W, and output the generated output signals to the image-display-panel-drive-unit 40. The process of computing the display data according to the present embodiment (Step S16) will now be explained in detail.

By including a fourth sub-pixel 49W that displays the fourth color (white) to a pixel 48, the display device 10 can increase a dynamic range of brightness in the HSV color space (extended HSV color space) as illustrated in FIG. 6. In other words, as illustrated in FIG. 6, the extended HSV color space has a shape obtained by placing a substantially trapezoidal three-dimensional space in which the maximum value of brightness V decreases as a saturation S increases on a cylindrical HSV color space that can be displayed with the first sub-pixel 49R, the second sub-pixel 49G, and the third sub-pixel 49B.

The image processing unit 22 of the signal processing unit 20 stores maximum values Vmax(S) of brightness with the saturation S serving as a variable in the HSV color space extended by the addition of the fourth color (white). In other words, with respect to the solid shape of the HSV color space illustrated in FIG. 6, the signal processing unit 20 stores the maximum values Vmax(S) of brightness for respective pairs of coordinates (values) of the saturation S and the hue H. Because the input signal includes the input signals for the first sub-pixel 49R, the second sub-pixel 49G, and the third sub-pixel 49B, the HSV color space of the input signal has a cylindrical shape, that is, the same shape as the cylindrical part of the extended HSV color space.

Next, based on at least the input signal (signal value $x_{1-(p,\ q)}$) and an extension coefficient $\alpha$ for the first sub-pixel 49R, the image processing unit 22 of the signal processing unit 20 calculates an output signal (signal value $X_{1-(p,\ q)}$) for the first sub-pixel 49R, and outputs the output signal to the first sub-pixel 49R. Based on at least the input signal (signal value $x_{2-(p,\ q)}$) and the extension coefficient $\alpha$ for the second sub-pixel 49G, the signal processing unit 20 calculates an output signal (signal value $X_{2-(p,\ q)}$) for the second sub-pixel 49G, and outputs the output signal to the second sub-pixel 49G. Based on at least the input signal (signal value $x_{3-(p,\ q)}$) and the extension coefficient $\alpha$ for the third sub-pixel 49B, the signal processing unit 20 calculates an output signal (signal value $X_{3-(p,\ q)}$) for the third sub-pixel 49B, and outputs the output signal to the third sub-pixel 49B. Based on the input signal (signal value $x_{1-(p,\ q)}$) for the first sub-pixel 49R, the input signal (signal value $x_{2-(p,\ q)}$) for the second sub-pixel 49G, and the input signal (signal value $x_{3-(p,\ q)}$) for the third sub-pixel 49B, the signal processing unit 20 calculates an output signal (signal value $X_{4-(p,\ q)}$) for the fourth sub-pixel 49W, and outputs the output signal to the fourth sub-pixel 49W.

Specifically, the image processing unit 22 of the signal processing unit 20 calculates the output signal for the first sub-pixel 49R based on the extension coefficient α for the first sub-pixel 49R and on the output signal for the fourth sub-pixel 49W. The image processing unit 22 calculates the output signal for the second sub-pixel 49G based on the extension coefficient α for the second sub-pixel 49G and on the output signal for the fourth sub-pixel 49W. The image processing unit 22 calculates the output signal for the third sub-pixel 49B based on the extension coefficient α for the third sub-pixel 49B and on the output signal for the fourth sub-pixel 49W.

In other words, assuming χ as a constant depending on the display device, the signal processing unit 20 uses Equations (1) to (3) listed below to obtain the signal value $X_{1-(p,\ q)}$ serving as the output signal for the first sub-pixel 49R, the signal value $X_{2-(p,\ q)}$ serving as the output signal for the second sub-pixel 49G, and the signal value $X_{3-(p,\ q)}$ serving as the output signal for the third sub-pixel 49B. The output signals are to be output to the (p, q)th pixel (or, the (p, q)th set of the first sub-pixel 49R, the second sub-pixel 49G, and the third sub-pixel 49B).

$$X_{1-(p,q)}=\alpha\cdot x_{1-(p,q)}-\chi\cdot X_{4-(p,q)} \tag{1}$$

$$X_{2-(p,q)}=\alpha\cdot x_{2-(p,q)}-\chi\cdot X_{4-(p,q)} \tag{2}$$

$$X_{3-(p,q)}=\alpha\cdot x_{3-(p,q)}-\chi\cdot X_{4-(p,q)} \tag{3}$$

The signal processing unit 20 obtains the maximum value Vmax(S) of brightness with the saturation S serving as a variable in the HSV color space extended by the addition of the fourth color, and based on the input signal values for the sub-pixels 49 in the pixels 48, obtains saturation values S and brightness values V(S) in the pixels 48.

The saturation S and the brightness V(S) are expressed as S=(Max−Min)/Max and V(S)=Max, respectively. The saturation S can have a value from 0 to 1, and the brightness V(S) can have a value from 0 to $(2^n-1)$. The exponent n is the number of display gradation bits. Max is the maximum value among the input signal value for the first sub-pixel 49R, the input value for the second sub-pixel 49G, and the input value for the third sub-pixel 49B, with respect to the pixels 48. Min is the minimum value among the input signal value for the first sub-pixel 49R, the input value for the second sub-pixel 49G, and the input value for the third sub-pixel 49B, with respect to the pixels 48. A hue H is expressed by a value from 0 degrees to 360 degrees as illustrated in FIG. 7. The hue H changes from 0 degrees toward 360 degrees as red, yellow, green, cyan, blue, magenta, and then red.

In the present embodiment, the signal value $X_{4-(p,\ q)}$ can be obtained based on the product of $Min_{(p,\ q)}$ and the extension coefficient α. Specifically, the signal value $X_{4-(p,\ q)}$ can be obtained based on Equation (4) given below. Although Equation (4) divides the product of $Min_{(p,\ q)}$ and the extension coefficient α by χ, the equation is not limited to this. The constant χ will be described later.

$$X_{4-(p,q)}=\mathrm{Min}_{(p,q)}\cdot\alpha/\chi \tag{4}$$

In general, in the (p, q)th pixel 48, Equations (5) and (6) below can be used to obtain the saturation $S_{(p,\ q)}$ and the brightness $V(S)_{(p,\ q)}$ in the cylindrical HSV color space based on the input signal (signal value $x_{1-(p,\ q)}$) for the first sub-pixel 49R, the input signal (signal value $x_{2-(p,\ q)}$) for the second sub-pixel 49G, and the input signal (signal value $x_{3-(p,\ q)}$) for the third sub-pixel 49B.

$$S_{(p,q)}=(\mathrm{Max}_{(p,q)}-\mathrm{Min}_{(p,q)})/\mathrm{Max}_{(p,q)} \tag{5}$$

$$V(S)_{(p,q)}=\mathrm{Max}(p,q) \tag{6}$$

$Max_{(p,\ q)}$ is the maximum value of the input signal values ($x_{1-(p,\ q)}$, $x_{2-(p,\ q)}$, and $x_{3-(p,\ q)}$) for the three sub-pixels 49. $Min_{(p,\ q)}$ is the minimum value of the input signal values ($x_{1-(p,\ q)}$, $x_{2-(p,\ q)}$, and $x_{3-(p,\ q)}$) for the three sub-pixels 49. The present embodiment assumes that n=8. In other words, the number of display gradation bits is assumed to be eight (the display gradation having a value in 256 levels of gradation from 0 to 255).

The fourth sub-pixel 49W, which displays white color, is not provided with a color filter. The fourth sub-pixel 49W for displaying the fourth color is brighter than the first sub-pixel 49R for displaying the first color, the second sub-pixel 49G for displaying the second color, and the third sub-pixel 49B for displaying the third color, when illuminated with the same light quantity. Suppose that the first sub-pixel 49R is supplied with a signal having a value equivalent to the maximum signal value of the output signal for the first sub-pixel 49R, that the second sub-pixel 49G is supplied with a signal having a value equivalent to the maximum signal value of the output signal for the second sub-pixel 49G, and that the third sub-pixel 49B is supplied with a signal having a value equivalent to the maximum signal value of the output signal for the third sub-pixel 49B. In that case, a collective set of the first sub-pixel 49R, the second sub-pixel 49G, and the third sub-pixel 49B included in the pixel 48 or a group of the pixels 48 is assumed to have a luminance value of $BN_{1-3}$. Furthermore, suppose that the fourth sub-pixel 49W included in the pixel 48 or a group of the pixels 48 is supplied with a signal having a value equivalent to the maximum signal value of the output signal for the fourth sub-pixel 49W. In that case, the fourth sub-pixel 49W is assumed to have a luminance value of $BN_4$. In other words, the collective set of the first sub-pixel 49R, the second sub-pixel 49G, and the third sub-pixel 49B displays white color having a maximum luminance value, and the luminance of the white color is represented by $BN_{1-3}$. Then, assuming χ as a constant depending on the display device, the constant χ is expressed as $\chi=BN_4/BN_{1-3}$.

Specifically, suppose that the luminance $BN_{1-3}$ of the white color is obtained when the collective set of the first sub-pixel 49R, the second sub-pixel 49G, and the third sub-pixel 49B is supplied with the input signals having the following values of the display gradation, that is, the signal value $x_{1-(p,\ q)}=255$, the signal value $X_{2-(p,\ q)}=255$, and the signal value $x_{3-(p,\ q)}=255$. Furthermore, suppose that the luminance $BN_4$ is obtained when the fourth sub-pixel 49W is supplied with the input signal having a value 255 of the display gradation. Then, the luminance BN4 has a value, for example, 1.5 times as large as the luminance $BN_{1-3}$. In other words, χ=1.5 is satisfied in the present embodiment.

When the signal value $X_{4-(p,\ q)}$ is given by Equation (4) above, Vmax(S) can be expressed by Equations (7) and (8) given below.

When $S\leq S_0$, $$V\mathrm{max}(S)=(\chi+1)\cdot(2^n-1) \tag{7}$$

When $S_0<S\leq 1$, $$V\max(S)=(2^n-1)\cdot(1/S) \quad (8)$$

where $S_0=1/(\chi+1)$.

The signal processing unit 20 stores, for example, as a kind of look-up table, the thus obtained maximum value Vmax(S) of brightness with the saturation S serving as a variable in the HSV color space extended by the addition of the fourth color. Otherwise, the signal processing unit 20 obtains the maximum value Vmax(S) of brightness with the saturation S serving as a variable in the extended HSV color space on a case-by-case basis.

A description will next be made of a method (extension process) of obtaining the signal values $X_{1-(p,\ q)}$, $X_{2-(p,\ q)}$, $X_{3-(p,\ q)}$, and $X_{4-(p,\ q)}$ serving as the output signals for the (p, q)th pixel 48. The following process is performed so as to keep a ratio among the luminance of the first primary color displayed by the (first sub-pixel 49R+fourth sub-pixel 49W), the luminance of the second primary color displayed by the (second sub-pixel 49G+fourth sub-pixel 49W), and the luminance of the third primary color displayed by the (third sub-pixel 49B+fourth sub-pixel 49W). The following process is performed so as to also keep (maintain) a color tone. The following process is performed so as to also keep (maintain) gradation-luminance characteristics (gamma characteristics, or γ characteristics). When all of the input signal values are zero or small in any of the pixels 48 or any group of the pixels 48, the extension coefficient α only needs to be obtained without including such a pixel 48 or such a group of the pixels 48.

First Step

First, based on the input signal values for the sub-pixels 49 of the pixels 48, the signal processing unit 20 obtains the saturation S and the brightness V(S) with respect to the pixels 48. Specifically, with respect to the (p, q)th pixel 48, the signal processing unit 20 obtains $S_{(p,\ q)}$ and $V(S)_{(p,\ q)}$ by using Equations (7) and (8) based on the signal value $x_{1-(p,\ q)}$) serving as the input signal for the first sub-pixel 49R, the signal value $x_{2-(p,\ q)}$ serving as the input signal for the second sub-pixel 49G, and the signal value $x_{3-(p,\ q)}$ serving as the input signal for the third sub-pixel 49B. The signal processing unit 20 applies this process to all of the pixels 48.

Second Step

Next, the signal processing unit 20 obtains the extension coefficient α(S) based on Vmax(S)/V(S) obtained with respect to the pixels 48.

$$\alpha(S)=V\max(S)/V(S) \quad (9)$$

Third Step

Subsequently, based on at least the signal values $X_{1-(p,\ q)}$, $x_{2-(p,\ q)}$, and $X_{3-(p,\ q)}$, the signal processing unit 20 obtains the signal value $X_{4-(p,\ q)}$ for the (p, q)th pixel 48. In the present embodiment, the signal processing unit 20 determines the signal value $X_{4-(p,\ q)}$ based on $Min_{(p,\ q)}$, the extension coefficient α, and the constant χ. More specifically, the signal processing unit 20 obtains the signal value $X_{4-(p,\ q)}$ based on Equation (4) given above as described above. The signal processing unit 20 obtains the signal values $X_{4-(p,\ q)}$ for all of the $P_0\times Q_0$ pixels 48.

Fourth Step

Thereafter, the signal processing unit 20 obtains the signal value $X_{1-(p,\ q)}$ for the (p, q)th pixel 48 based on the signal value $x_{1-(p,\ q)}$, the extension coefficient α, and the signal value $X_{4-(p,\ q)}$. The signal processing unit 20 obtains the signal value $X_{2-(p,\ q)}$ for the (p, q)th pixel 48 based on the signal value $x_{2-(p,\ q)}$, the extension coefficient α, and the signal value $X_{4-(p,\ q)}$. The signal processing unit 20 obtains the signal value $X_{3-(p,\ q)}$ for the (p, q)th pixel 48 based on the signal value $x_{3-(p,\ q)}$, the extension coefficient α, and the signal value $X_{4-(p,\ q)}$. Specifically, the signal processing unit 20 obtains the signal values $X_{1-(p,\ q)}$, $X_{2-(p,\ g)}$, and $X_{3-(p,\ q)}$ for the (p, q)th pixel 48 based on Equations (1) to (3) given above.

As indicated by Equation (4), the signal processing unit 20 extends the value of $Min_{(p,\ q)}$ according to the extension coefficient α. In this manner, the extension of $Min_{(p,\ q)}$ according to the extension coefficient α increases the luminance of the white display sub-pixel (fourth sub-pixel 49W), and also increases the luminance of the red display sub-pixel, the green display sub-pixel, and the blue display sub-pixel (corresponding to the first sub-pixel 49R, the second sub-pixel 49G, and the third sub-pixel 49B, respectively) as indicated by Equations given above. This can avoid a problem of occurrence of dulling of colors. Specifically, the extension of the value of $Min_{(p,\ q)}$ according to the extension coefficient α increases the luminance of an entire image by a factor of α compared with a case in which the value of $Min_{(p,\ q)}$ is not extended. This allows, for example, a still image to be displayed at high luminance, which is desirable.

As illustrated in FIG. 9, the signal processing unit 20 computes the display data (Step S16), and analyzes the image represented by the input signal SRGB (Step S12).

The image analyzing unit 23 analyzes that a signal value $X_{1-(p,\ q)}$, a signal value $X_{2-(p,\ q)}$, a signal value $X_{3-(p,\ q)}$, and a signal value $X_{4-(p,\ q)}$ for the (p, q)th pixel 48 are extended by a factor of α. In order to achieve an image with the same luminance as that of the image resulting from the signal values not extended, based on the information on the image input signal SRGB, the display device 10 may reduce the quantity of light emitted from the planar-light-source-device 50 based on the extension coefficient α. Specifically, the light-source-drive-value-computing-unit 24 and the light-source-drive-value-determining-unit 26 may control the current or the duty ratio for each of the light sources 56A, 56B, 56C, 56D, 56E, and 56F independently so that the quantity of light emitted from the planar-light-source-device 50 is reduced by (1/α). That is to say, the image analysis is performed in Step S12, and then, for example, (1/α) is set for each of the light sources 56A, 56B, 56C, 56D, 56E, and 56F independently.

Figure 10:
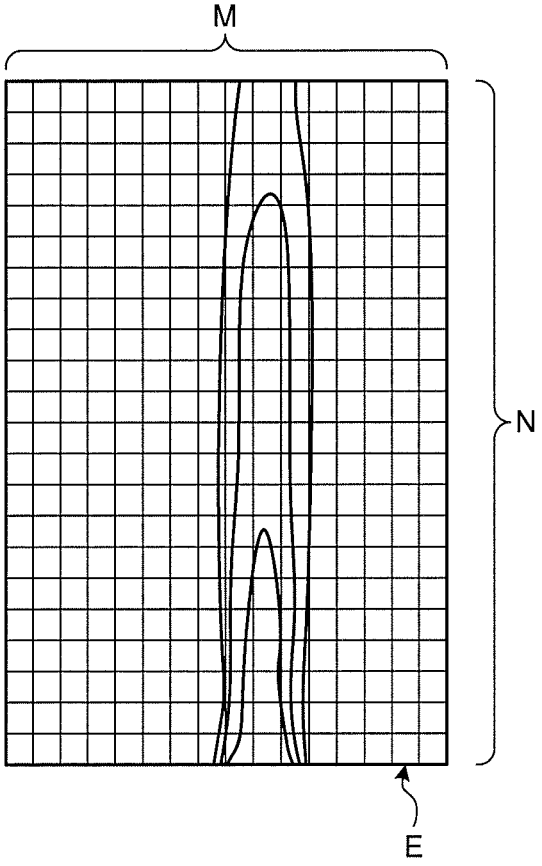
FIG. 10 is a schematic for explaining information on a light intensity distribution of light that is incident on the light guide plate from a specific light source and is emitted to a plane of the image display panel from the light guide plate.
Figure 11:
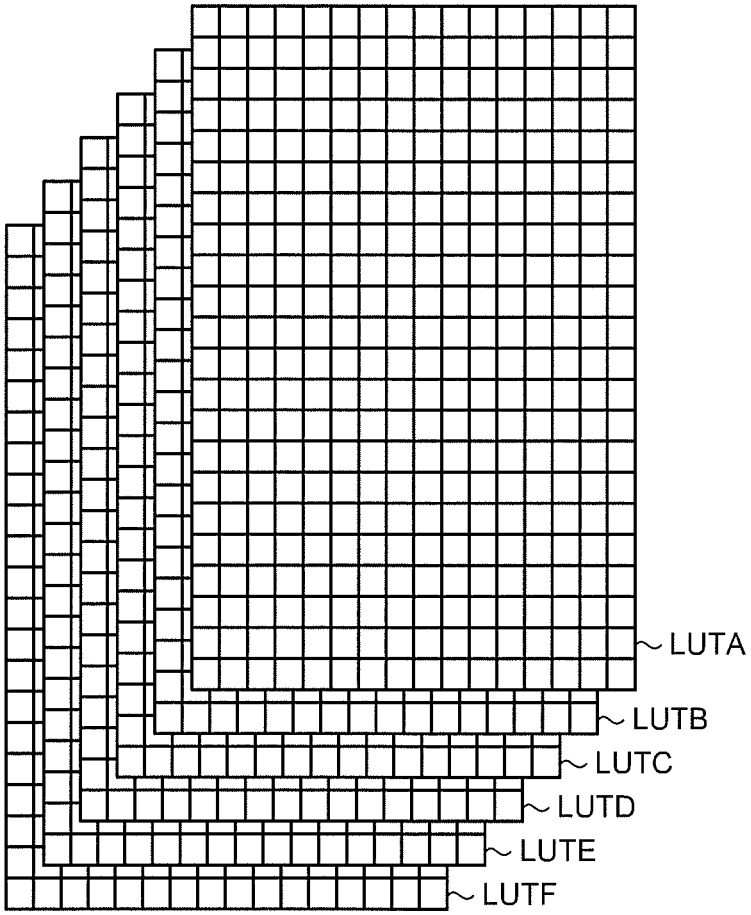
FIG. 11 is a schematic for explaining lookup tables.

Lookup Tables, which are used in a process described later, are explained below. FIG. 10 is a schematic for explaining information on a light intensity distribution of light that is incident on the light guide plate from a specific light source and is emitted to a plane of the image display panel from the light guide plate. FIG. 11 is a schematic for explaining lookup tables. In the present embodiment, the light-source-data-storage-unit 25 stores therein a plurality of lookup tables (LUTs) each of which is data of an array including M×N array elements and stores therein a representative value of the light intensity for each array element. M represents the number of array elements in the light-source-arrangement-direction LY (the number of columns). N represents the number of array elements in the incidence direction LX (the number of rows). For example, M×N array elements may correspond to the respective pixels. The array elements corresponding to the respective pixels may be thinned out at equal intervals and stored in each lookup table. As another example, each of the lookup tables may store therein the representative value of the light intensity for each divided area obtained by virtually dividing the plane of the image display panel 30 into M×N. In this case, the representative value may be, but is not limited to, an average or a median of the light intensity in each divided area, or a light intensity value at any position in each divided area. The data in the lookup tables is the representative value for each divided area, but is not limited thereto. In the present embodiment, the light-source-data-storage-unit 25 stores therein the lookup tables respectively corresponding to the light sources. For example, as illustrated in FIG. 11, the light-source-data-storage-unit 25 stores therein the information on the light intensity distribution (see FIG. 4) obtained when the light incident on the light guide plate 54 from the light source 56A is emitted to the plane of the image display panel 30 from the light guide plate 54 in a case where only the light source 56A illustrated in FIG. 3 emits light with a predetermined light quantity, as a lookup table LUTA. The light-source-data-storage-unit 25 also stores therein the information on a light intensity distribution obtained when the light incident on the light guide plate 54 from the light source 56B is emitted to the plane of the image display panel 30 from the light guide plate 54 in a case where only the light source 56B illustrated in FIG. 3 emits light with the predetermined light quantity, as a lookup table LUTB. The light-source-data-storage-unit 25 also stores therein the information on a light intensity distribution obtained when the light incident on the light guide plate 54 from the light source 56C is emitted to the plane of the image display panel 30 from the light guide plate 54 in a case where only the light source 56C illustrated in FIG. 3 emits light with the predetermined light quantity, as a lookup table LUTC. The light-source-data-storage-unit 25 also stores therein the information on a light intensity distribution obtained when the light incident on the light guide plate 54 from the light source 56D is emitted to the plane of the image display panel 30 from the light guide plate 54 in a case where only the light source 56D illustrated in FIG. 3 emits light with the predetermined light quantity, as a lookup table LUTD. The light-source-data-storage-unit 25 also stores therein the information on a light intensity distribution obtained when the light incident on the light guide plate 54 from the light source 56E is emitted to the plane of the image display panel 30 from the light guide plate 54 in a case where only the light source 56E illustrated in FIG. 3 emits light with the predetermined light quantity, as a lookup table LUTE. The light-source-data-storage-unit 25 also stores therein the information on a light intensity distribution obtained when the light incident on the light guide plate 54 from the light source 56F is emitted to the plane of the image display panel 30 from the light guide plate 54 in a case where only the light source 56F illustrated in FIG. 3 emits light with the predetermined light quantity, as a lookup table LUTF.

The lookup tables LUTA, LUTB, LUTC, LUTD, LUTE, and LUTF according to the present embodiment correspond to the light sources 56A, 56B, 56C, 56D, 56E, and 56F, respectively. The lookup tables according to the present embodiment may be stored for when each pair of the light sources 56A and 56B, the light sources 56C and 56D, and the light sources 56E and 56F emits light at the same time, for example. This configuration can reduce the process for creating the lookup tables and the storage capacity occupied in the light-source-data-storage-unit 25, so that the integrated circuit storing therein the light-source-data-storage-unit 25 can be reduced in size.

When the light sources 56A, 56B, and 56C are positioned in a line symmetry to the light sources 56F, 56E, and 56D with respect to the center line LYc in the light-source-arrangement-direction LY, among the lookup tables LUTA, LUTB, LUTC, LUTD, LUTE, and LUTF, only the lookup tables LUTA, LUTB, and LUTC positioned on one side of the center line LYc in the light-source-arrangement-direction LY may be prepared and stored, without preparing and storing the lookup tables LUTD, LUTE, and LUTF positioned on the other side, because these lookup tables LUTD, LUTE, and LUTE are line symmetric to the lookup tables LUTA, LUTB, and LUTC, respectively, with respect to the center line LYc.

The light-source-drive-value-computing-unit 24 refers to the lookup tables LUTA, LUTB, LUTC, LUTD, LUTE, and LUTE in the light-source-data-storage-unit 25 to compute the light quantity of each of the light sources 56A, 56B, 56C, 56D, 56E, and 56F by superimposing the lookup tables LUTA, LUTB, LUTC, LUTD, LUTE, and LUTF over one another such that a quantity of light emitted from the planar-light-source-device 50 approximates ($1/\alpha$) times of a quantity of light emitted from the planar-light-source-device 50 of when an image not extended by a is displayed (Step S13). For example, the (i, j)th representative luminance (where $1 \le i \le N$, $1 \le j \le M$) obtained by superimposing lookup tables LUTA, LUTE, LUTC, LUTD, LUTE, and LUTF can be computed by Equation (10).

$$T(i, j) = \sum_{k=0}^{n} \{T_{k(i,j)} \times (I_c / \alpha_k)\} \tag{10}$$

$T_{k(i,j)}$: Value of lookup table corresponding to each light source $I_c/\alpha_k$: Corresponding light source current In this manner, the light-source-drive-value-computing-unit 24 can reduce the amount of computations, because the complex computation is replaced by a simple reference to the lookup tables LUTA, LUTB, LUTC, LUTD, LUTE, and LUTF.

As mentioned earlier, to cause the image-display-panel-drive-unit 40 to make a display on the image display panel 30, a luminance distribution in units of the pixels 48 is required. The light-source-drive-value-determining-unit 26 computes a luminance distribution in units of the pixels 48 based on the light quantity of each of the light sources 56A, 56B, 56C, 56D, 56E, and 56F emit light calculated at Step S13 and the lookup tables LUTA, LUTE, LUTC, LUTD, LUTE, and LUTF (Step S14). To calculate the luminance distribution in units of the pixels 48, luminance information for each pixel 48 is computed by interpolation calculating. The resulting information in units of the pixels 48 would have an extremely large amount of information. However, in the present embodiment, because the lookup tables LUTA, LUTE, LUTC, LUTD, LUTE, and LUTF are created using thinned representative values, the size of the lookup tables can be reduced. The light-source-drive-value-determining-unit 26 can reduce computational loads by performing linear interpolation.

Figure 12:
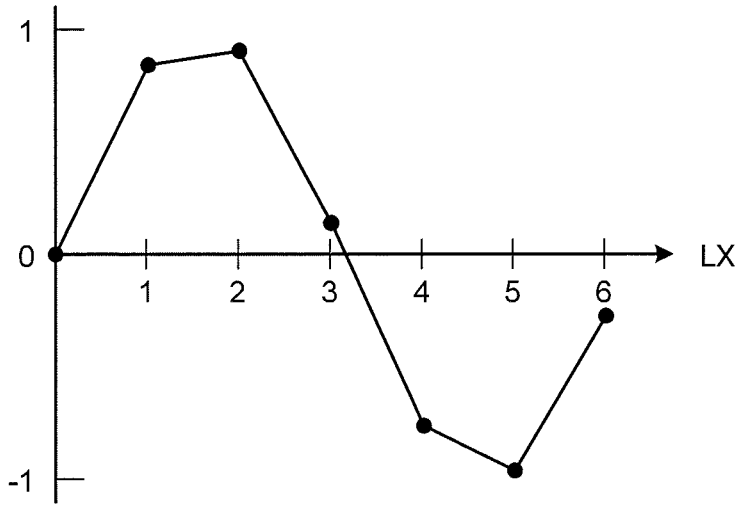
FIG. 12 is an explanatory diagram for explaining a linear interpolation.
Figure 13:
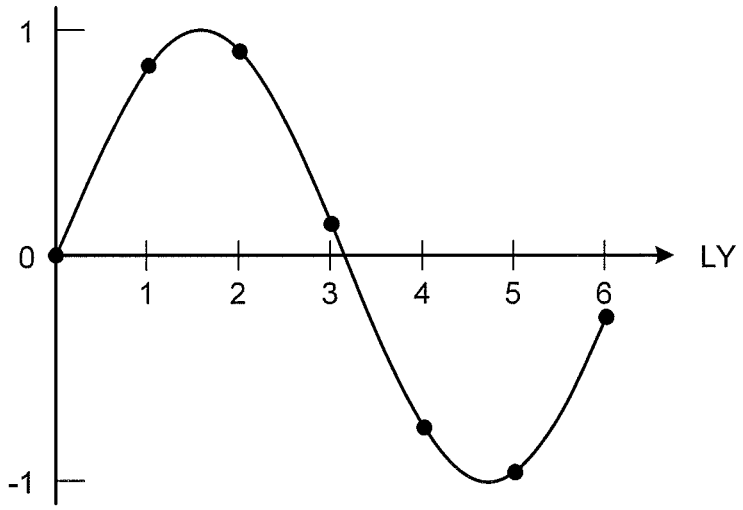
FIG. 13 is an explanatory diagram for explaining a polynomial interpolation.

The luminance information in units of the pixels 48 changes steeply in the light-source-arrangement-direction LY while the change in the incidence direction LX is gentle. FIG. 12 is an explanatory diagram for explaining a linear interpolation. FIG. 13 is an explanatory diagram for explaining a polynomial interpolation. As the interpolation, the interpolation illustrated in FIG. 12 is applied to the luminance information of the pixels 48 in the incidence direction LX, and the polynomial interpolation illustrated in FIG. 13 is applied to the luminance information of the pixels 48 in the light-source-arrangement-direction LY. An example of the polynomial interpolation is the cubic interpolation. With the interpolation, only stored in each of the lookup tables LUTA, LUTB, LUTC, LUTD, LUTE, and LUTF are M pieces of data, M being the sum of the number of light sources and the number of spaces each of which is between two light sources in the light-source-arrangement-direction LY. In this manner, the sizes of the lookup tables can be reduced greatly.

The light-source-data-storage-unit 25 serving as the controller stores therein the lookup tables LUTA, LUTB, and LUTC corresponding to the respective light sources 56A, 56B, and 56C positioned on one side of the center line LYc in the light-source-arrangement-direction LY. The light-source-drive-value-computing-unit 24 reads the information in the lookup tables LUTC, LUTB, and LUTA corresponding to the respective light sources 56C, 56B, and 56A that are line symmetric to the light sources 56D, 56E, and 56F, respectively, with respect to the center line LYc, as the information on the light intensity distributions of the light emitted to the plane of the image display panel 30 from the respective light sources 56D, 56E, and 56F positioned on the other side of the center line LYc. That is, among the luminance information of the pixels 48 of the image display panel 30, luminance information for only one side with respect to the center line LYc in the light-source-arrangement-direction LY may be stored (retained) in the lookup tables. The luminance information for the one side can be used for the other side that is line symmetric to the one side with respect to the center line LYc. In this manner, it is not necessary to store lookup tables for the other side. Therefore, the light-source-drive-value-determining-unit 26 can reduce the sizes of the lookup tables greatly.

The light-source-drive-value-determining-unit 26 then sends the luminance information, which is obtained in Step S14, for each pixel 48 to the image processing unit 22. The image processing unit 22 corrects the input signal SRGB based on the luminance information for each pixel 48 (Step S16), and performs a synchronizing process of computing an output signal SRGBW for outputting the signal value $X_{1-(p,\ q)}$, the signal value $X_{2-(p,\ q)}$, the signal value $X_{3-(p,\ q)}$, and the signal value $X_{4-(p,\ q)}$ for the (p, q)th pixel 48 (Step S15). Based on the synchronizing signal STM, the image-display-panel-drive-unit 40 displays an image on the image display panel 30 for each frame, and the planar-light-source-device-control-unit 60 drives each of the light sources 56A, 56B, 56C, 56D, 56E, and 56F in the planar-light-source-device 50 independently. As described above, the method of driving a display device includes detecting an image input signal (S11), analyzing the image (S12), and computing the light quantity of each of the light sources based on the result of the image analysis, and based on the lookup tables corresponding to the respective light sources and storing therein the information on the light intensity distribution obtained when the light incident on the light guide plate 54 from the respective light sources is emitted to the plane of the image display panel 30 from the light guide plate 54 (S13). In this manner, the controller can control to reduce the total amount of the light quantities of the light sources 56A, 56B, 56C, 56D, 56E, and 56F, and therefore, the power consumption can be reduced.

The display device 10 includes the image display panel 30 and the planar-light-source-device 50. The planar-light-source-device 50 is a planar light source and includes the light guide plate 54 and the edge-lit light source 52. The image-display-panel-drive-unit 40 and the planar-light-source-device-control-unit 60 operate synchronously as the controller, based on the operations performed by the signal processing unit 20, and control the light quantity of each of the light sources 56A, 56B, 56C, 56D, 56E, and 56F independently, based on the information on an image input signal SRGB and the lookup tables LUTA, LUTB, LUTC, LUTD, LUTE, and LUTF. In this manner, the controller can control to reduce the total amount of light quantities of the light sources 56A, 56B, 56C, 56D, 56E, and 56F, and therefore, the power consumption can be reduced.

First Modification

Figure 14:
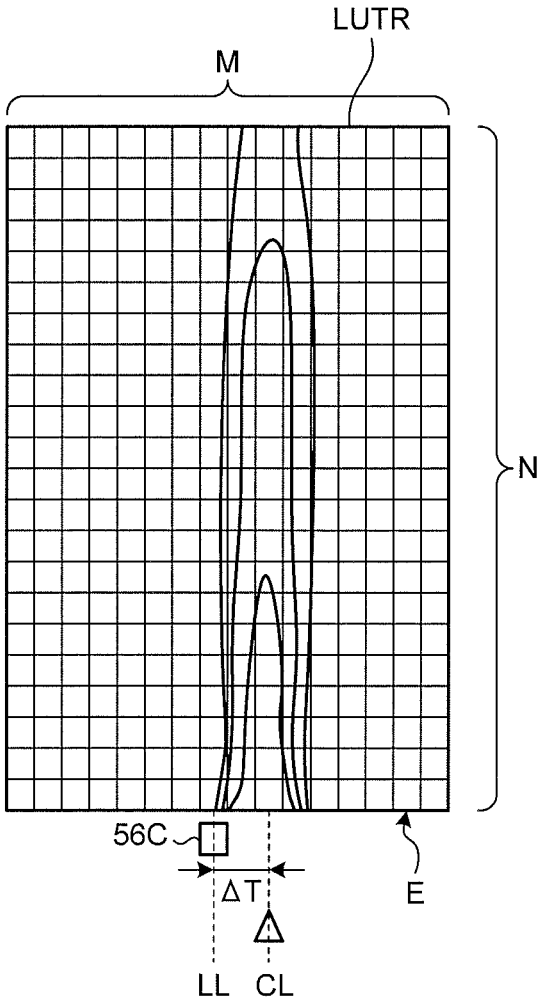
FIG. 14 is an explanatory diagram for explaining a misalignment of the light sources with respect to the image display panel.

FIG. 14 is an explanatory diagram for explaining a misalignment of the light sources with respect to the image display panel. Generally, the light guide plate 54 is a component separate from the light sources 56A, 56B, 56C, 56D, 56E, and 56F in the display device 10, so these components may be misaligned during assembly, as a production variation. For example, because the planar-light-source-device 50 is a flexible printed circuit on which the light sources 56A, 56B, 56C, 56D, 56E, and 56F are mounted, the light sources 56A, 56B, 56C, 56D, 56E, and 56F may be misaligned altogether with respect to the light guide plate 54, while the pitch between the light sources 56A, 56B, 56C, 56D, 56E, and 56F is kept constant. Because the planar-light-source-device 50 is also a separate component from the image display panel 30, these components may also be misaligned with respect to each other in the assembly.

The display device 10 according to the present embodiment causes each of the light sources 56A, 56B, 56C, 56D, 56E, and 56F to emit light independently, and adjusts the image information for each pixel 48 based on the luminance distribution of the planar-light-source-device 50. Therefore, if a computed luminance distribution does not match the luminance distribution of the actual planar-light-source-device 50, the display quality of the image displayed on the image display panel 30 may deteriorate.

In the display device 10 according to the present embodiment, the distance ΔT between the actual position LL of the light source 56C and a reference position CL is measured during the production process, as illustrated in FIG. 14. The reference position CL is the ideal position at which the light source 56C is mounted on the light guide plate 54. If the position is misaligned by a distance equal to or more than a predetermined threshold in the light-source-arrangement-direction LY, a correction is performed on the coordinates of the lookup table LUTR by shifting the coordinates by the distance ΔT at Step S14 described above. The lookup table LUTR represents any one of any one of the lookup tables LUTA, LUTE, LUTC, LUTD, LUTE, and LUTF. In this manner, the display device 10 according to a first modification of the present embodiment can suppress image display quality deteriorations caused by misalignment of the components resulting from the assembly. The distance ΔT may be detected with a sensor provided in the display device 10. FIG. 14 illustrates the same lookup table as the lookup table LUTC as an example of the lookup table LUTR, but the lookup table LUTR may be any one of the lookup tables LUTA, LUTB, LUTC, LUTD, LUTE, and LUTE.

Second Modification

Figure 15:
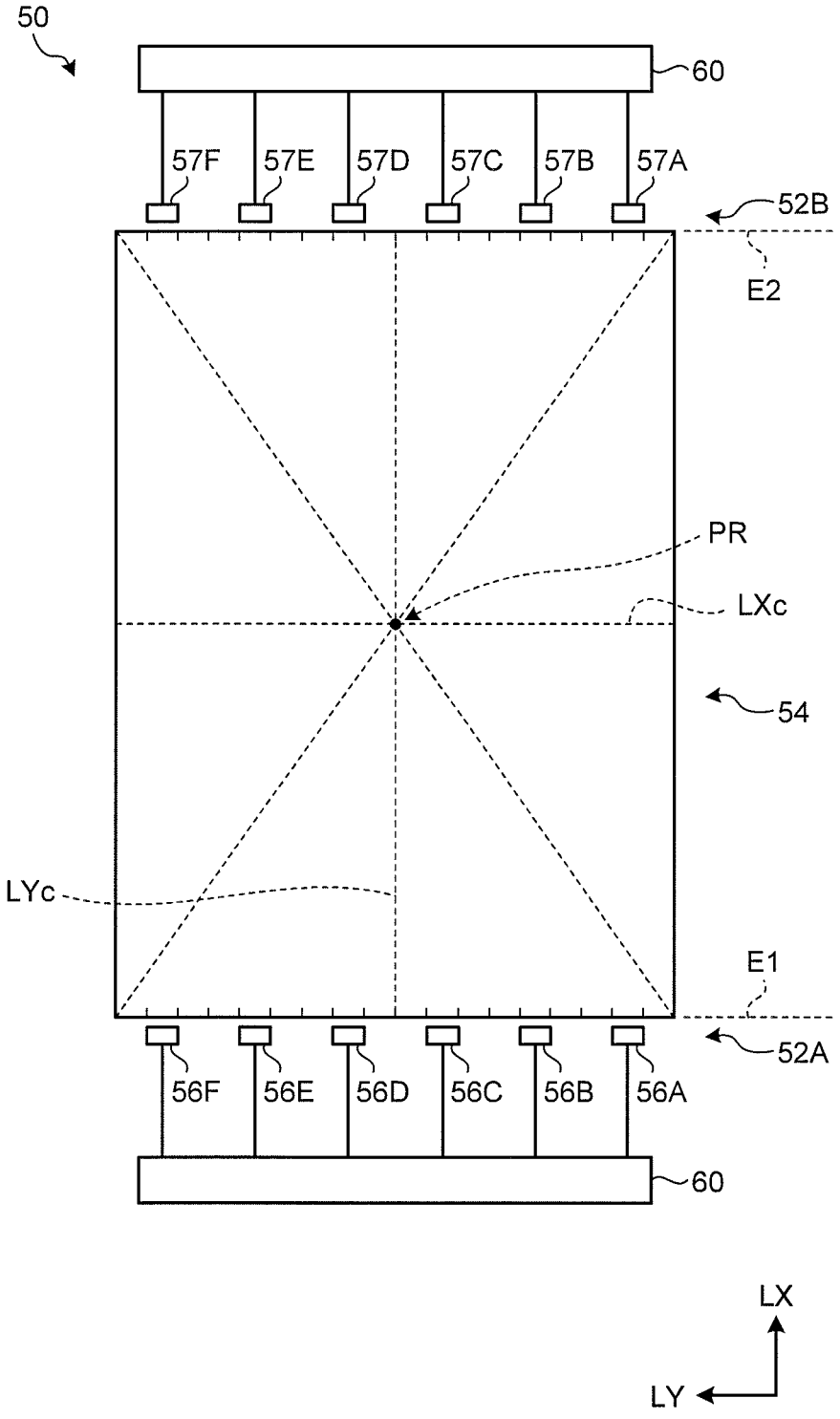
FIG. 15 is an explanatory diagram for explaining an edge-lit light source according to a modification of the first embodiment.

FIG. 15 is an explanatory diagram for explaining an edge-lit light source according to another modification of the present embodiment. This planar-light-source-device 50 includes the light guide plate 54, a first edge-lit light source 52A, and a second edge-lit light source 52B. The first edge-lit light source 52A includes a plurality of light sources 56A, 56B, 56C, 56D, 56E, and 56F that are provided facing a plane of incidence E1. The second edge-lit light source 52B includes a plurality of light sources 57A, 57B, 57C, 57D, 57E, and 57F that are provided facing another plane of incidence E2. The planes of incidence E1 and E2 correspond to at least both side surfaces of the light guide plate 54. The planar-light-source-device-control-unit 60 can control the current to be supplied to or the duty ratio of the voltage or the current for each of the light sources 56A, 56B, 56C, 56D, 56E, 56F, 57A, 57B, 57C, 57D, 57E, and 57F illustrated in FIG. 15 independently, thereby controlling the quantity (intensity) of light emitted from each of the light sources 56A, 56B, 56C, 56D, 56E, 56F, 57A, 57B, 57C, 57D, 57E, and 57F independently.

The planar-light-source-device 50 according to the second modification of the present embodiment has the first edge-lit light source 52A and the second edge-lit light source 52B. Therefore, if the light-source-data-storage-unit 25 stores therein, for each light source, a lookup table including information on a light intensity distribution (see FIG. 4) obtained when light incident on the light guide plate 54 from one of the light sources 56A, 56B, 56C, 56D, 56E, 56F, 57A, 57B, 57C, 57D, 57E, and 57F is emitted to the plane of the image display panel 30 from the light guide plate 54 in a case where only the one of the light sources 56A, 56B, 56C, 56D, 56E, 56F, 57A, 57B, 57C, 57D, 57E, and 57F emits light, the number of the lookup tables to be stored is increased, because there are two planes of incidence, the first and the second plane of incidence E1 and E2. In the first edge-lit light source 52A and the second edge-lit light source 52B, the light sources 56A, 56B, 56C, 56D, 56E, and 56F are positioned line symmetrically to the light sources 57A, 57B, 57C, 57D, 57E, and 57F, respectively, with respect to the center line LXc in the incident direction LX. When the light is emitted from only one of the light sources on the side of the second plane of incidence E2, and becomes incident on the light guide plate 54 and is emitted to the plane of the image display panel 30 from the light guide plate 54, the information in the lookup table representing the light intensity distribution of the incident light is the same as that in the lookup table of the light source positioned on the side of the first plane of incidence E1, the light source being line symmetric to the light source emitting light with respect to the center line LXc in the incident direction LX. As mentioned earlier, the lookup tables LUTA, LUTE, LUTC, LUTD, LUTE, and LUTF according to the present embodiment correspond to the light sources 56A, 56B, 56C, 56D, 56E, and 56F, respectively. As long as the light-source-data-storage-unit 25 stores therein the lookup tables LUTA, LUTE, LUTC, LUTD, LUTE, and LUTF, the light-source-drive-value-computing-unit 24 can compute the light quantity of each of the light sources 57A, 57B, 57C, 57D, 57E, and 57F by referring to the lookup tables LUTA, LUTB, LUTC, LUTD, LUTE, and LUTF in the light-source-data-storage-unit 25, not only for the first edge-lit light source 52A but also for the second edge-lit light source 52B, and by superimposing the lookup tables LUTA, LUTB, LUTC, LUTD, LUTE, and LUTE over one another in such a manner that a quantity of light emitted from the planar-light-source-device 50 approximates ($1/\alpha$) times of a quantity of light emitted from the planar-light-source-device 50 of when an image not extended by $\alpha$ is displayed.

As explained above, the planar-light-source-device 50 includes the first edge-lit light source 52A and the second edge-lit light source 52B. The light-source-data-storage-unit 25 serving as the controller stores therein the lookup tables LUTA, LUTB, and LUTC for the respective light sources 56A, 56B, and 56C positioned on one side of the center line LYc in the light-source-arrangement-direction LY. The light-source-drive-value-computing-unit 24 reads the information in the lookup tables LUTC, LUTB, and LUTA corresponding to the respective light sources 56C, 56B, and 56A that are line symmetric to the light sources 56D, 56E, and 56F, respectively, with respect to the center line LYc, as the information on the light intensity distributions of the light that is emitted to the plane of the image display panel 30 from the respective light sources 56D, 56E, and 56F positioned on the other side of the center line LYc. In the manner described above, the light-source-data-storage-unit 25 may store therein the lookup tables LUTA, LUTE, LUTC, LUTD, LUTE, and LUTF for the light sources on one side of the center line LXc in the incident direction LX, without storing the lookup tables for the light sources on the other side, because the latter light sources are line symmetric to the former light sources with respect to the center line LXc. That is, among the luminance information of the pixels 48 of the image display panel 30, luminance information for only one side with respect to the center line LXc in the incident direction LX may be stored (retained) in the lookup tables. The luminance information for the one side can be used for the other side that is line symmetric to the one side with respect to the center line LXc. In this manner, it is not necessary to store lookup tables for the other side. Therefore, the light-source-drive-value-determining-unit 26 can reduce the sizes of the lookup tables greatly.

The planar-light-source-device 50 according to the second modification of the present embodiment can further reduce the lookup tables. For example, the light sources 56A, 56B, and 56C are mounted on the light guide plate 54 in line symmetry to the light sources 56F, 56E, and 56D, respectively, with respect to the center line LYc in the light-source-arrangement-direction LY. Similarly, the light sources 57A, 57B, and 57C are mounted on the light guide plate 54 in line symmetry to the light sources 57F, 57E, and 57D, respectively, with respect to the center line LYc in the light-source-arrangement-direction LY. The light-source-data-storage-unit 25, therefore, stores therein the lookup tables LUTA, LUTE, and LUTC.

The light sources 56A, 56B, and 56C are positioned line symmetrically to the light sources 56F, 56E, and 56D, respectively, with respect to the center line LYc in the light-source-arrangement-direction LY. The light-source-drive-value-computing-unit 24 therefore refers to the lookup tables LUTA, LUTB, and LUTC for the respective light sources 56A, 56B, and 56C that are on one side of the center line LYc in the light-source-arrangement-direction LY, and refers to the same lookup tables LUTA, LUTE, and LUTC for the light sources 56F, 56E, and 56D, respectively, positioned on the other side in a line symmetry to the respective light sources 56A, 56B, and 56C with respect to the center line LYc in the light-source-arrangement-direction LY.

For the light sources 57A, 57B, and 57C, the light-source-drive-value-computing-unit 24 refers to the lookup tables LUTA, LUTB, and LUTC corresponding to the respective light sources 56A, 56B, and 56C that are line symmetric to the light sources 57A, 57B, and 57C, respectively, with respect to the center line LXc in the incident direction LX. For the light source 57F, the light-source-drive-value-computing-unit 24 refers to the lookup table LUTA corresponding to the light source 56A that is point symmetric to the light source 57F with respect to the center point PR where the center line LXc intersects with the center line LYc. For the light source 57E, the light-source-drive-value-computing-unit 24 refers to the lookup table LUTB corresponding to the light source 56B that is point symmetric to the light source 57E with respect to the center point PR. For the light source 57D, the light-source-drive-value-computing-unit 24 refers to the lookup table LUTC corresponding to the light source 56C that is point symmetric to the light source 57D with respect to the center point PR. In this manner, for the light sources 57D, 57E, and 57F, the light-source-drive-value-computing-unit 24 refers to the lookup tables LUTC, LUTB, and LUTA corresponding to the respective light sources 56C, 56B, and 56A that are line symmetric to the light sources 57D, 57E, and 57F, respectively, with respect to the center line LXc in the incident direction LX and with respect to the center line LYc in the light-source-arrangement-direction LY (that is, twice-symmetric).

As explained above, the planar-light-source-device 50 includes the first edge-lit light source 52A and the second edge-lit light source 52B. The light-source-data-storage-unit 25 serving as the controller stores therein the lookup tables LUTA, LUTB, and LUTC for the light sources 56A, 56B, and 56C positioned on one side of the center line LYc in the light-source-arrangement-direction LY. As the information on light intensity distributions of the light that is emitted to the plane of the image display panel 30 from the respective light sources 56D, 56E, and 56F positioned on the other side of the center line LYc, the light-source-drive-value-computing-unit 24 reads the information in the lookup tables LUTC, LUTB, and LUTA, respectively, corresponding to the respective light sources 56C, 56B, and 56A that are line symmetric to the light sources 56D, 56E, and 56F, respectively, with respect to the center line LYc. As the information on the light intensity distributions of the light that is emitted to the plane of the image display panel 30 from the light sources 57A, 57B, and 57C that are on one side of center line LYc of the second edge-lit light source 52B, the light-source-drive-value-computing-unit 24 reads the information in the respective lookup tables LUTA, LUTB, and LUTC corresponding to the respective light sources 56A, 56B, and 56C that are line symmetric to the light sources 57A, 57B, and 57C, respectively, with respect to the center line LXc. As the information on the light intensity distributions of the light that is emitted to the plane of the image display panel 30 from the respective light sources 57D, 57E, and 57F on the other side of the center line LYc of the second edge-lit light source 52B, the light-source-drive-value-computing-unit 24 reads the information in the lookup tables LUTC, LUTB, and LUTA corresponding to the respective light sources 56C, 56B, and 56A that are point symmetric to the light sources 57D, 57E, and 57F, respectively, with respect to the center point PR where the center line LXc intersects with the center line LYc. The light-source-drive-value-computing-unit 24 then superimposes the read and stored luminance information of the pixels 48 of the image display panel 30, and computes the light quantity of each of the light sources 56A, 56B, 56C, 56D, 56E, 56F, 57A, 57B, 57C, 57D, 57E, and 57F in such a manner that a quantity of light emitted from the planar-light-source-device 50 approximates $(1/\alpha)$ times of a quantity of light emitted from the planar-light-source-device 50 of when an image not extended by $\alpha$ is displayed. In this manner, the light-source-drive-value-computing-unit 24 can replace the complex computations with simple reference to the lookup tables LUTA, LUTE, LUTC, LUTD, LUTE, and LUTF, so that the amount of computations can be reduced. The sizes of the lookup tables required to be stored in advance can therefore be reduced greatly.

The image display panel 30 and the planar-light-source-device 50 (the light guide plate 54) described above are longer in the incident direction LX than in the light-source-arrangement-direction LY; however, the lengths in the incident direction LX and in the light-source-arrangement-direction LY are not limited to this. The length in the light-source-arrangement-direction LY may be larger than that in the incident direction LX, or may be the same as that in the incident direction LX.

As another example, the planar-light-source-device 50 may include the first edge-lit light source 52A and the second edge-lit light source 52B, and may use only the lookup table LUTA as information on the light intensity distributions of the light that is emitted to the plane of the image display panel 30 from the remaining light sources. The light sources 56A, 56F, 57A, and 57F positioned on the ends of the light guide plate 54 in the light-source-arrangement-direction LY are more easily affected by members provided around the light guide plate 54. For the light sources 56B, 56C, 56D, 56E, 57B, 57C, 57D and 57E, therefore, the light-source-drive-value-computing-unit 24 may store and read the same lookup table, and perform the following process for the light sources 56A, 56F, 57A, and 57F that are provided on the ends of the light guide plate 54 in the light-source-arrangement-direction LY.

The light-source-data-storage-unit 25 serving as the controller stores therein the lookup table LUTA corresponding to the light source 56A that is on one side of the center line LYc in the light-source-arrangement-direction LY. As the information on the light intensity distribution of the light that is emitted to the plane of the image display panel 30 from the light source 56F positioned on the other side of the center line LYc, the light-source-drive-value-computing-unit 24 reads the information in the lookup table LUTA corresponding to the light source 56A that is line symmetric to the light source 56F with respect to the center line LYc. As the information on the light intensity distribution of the light that is emitted to the plane of the image display panel 30 from the light source 57A positioned on one side of the center line LYc of the second edge-lit light source 52B, the light-source-drive-value-computing-unit 24 reads the information in the lookup table LUTA corresponding to the light source 56A that is line symmetric to the light source 57A with respect to the center line LXc. As information on the light intensity distribution of the light that is emitted to the plane of the image display panel 30 from the light source 57F positioned on the other side of the center line LYc of the second edge-lit light source 52B, the light-source-drive-value-computing-unit 24 reads the information in the lookup table LUTA corresponding to the light source 56A that is point symmetric to the light source 57F with respect to the center point PR where the center line LXc intersects with the center line LYc. The light-source-drive-value-computing-unit 24 then superimposes the read and stored luminance information of the pixels 48 of the image display panel 30, and computes the light intensity of each of the light sources 56A, 56B, 56C, 56D, 56E, 56F, 57A, 57B, 57C, 57D, 57E, and 57F emit light in such a manner that a quantity of light emitted from the planar-light-source-device 50 approximates the $(1/\alpha)$ times of a quantity of light emitted from the planar-light-source-device 50 of when an image not extended by a is displayed. In this manner, the light-source-drive-value-computing-unit 24 can replace the complex computations with simple reference to the lookup tables LUTA, LUTE, LUTC, LUTD, LUTE, and LUTF, so that the amount of computations can be reduced. The sizes of the lookup tables required to be stored in advance can therefore be reduced greatly.

In the explanation above, the center line LXc and the center line LYc are explained to be the center lines of the light guide plate 54, but when the center lines of the effective area of the light guide plate 54 are different from those of the light guide plate 54, the center lines of the effective area of the light guide plate 54 are used as the center line LXc and the center line LYc.

Second Embodiment

The same elements as those described in the first embodiment and the first and the second modifications are assigned with the same reference numerals and redundant explanations thereof are omitted herein.

The display device includes the image display panel 30, and the planar-light-source-device 50 that is a planar light source including the light guide plate 54 and the edge-lit light source 52. Based on the operations of the signal processing unit, the image-display-panel-drive-unit 40 and the planar-light-source-device-control-unit 60 operate synchronously as the controller, to control the light quantity of each of the light sources 56A, 56B, 56C, 56D, 56E, and 56F individually and independently, based on the information on the image input signal SRGB and the lookup tables LUTA, LUTB, LUTC, LUTD, LUTE, and LUTF corresponding to the respective light sources. In this manner, the controller can control to reduce the total amount of the light quantities of the light sources 56A, 56B, 56C, 56D, 56E, and 56F emit light, and therefore, the power consumption can be reduced.

While the luminance information for each pixel 48 can be transmitted to the image processing unit 22 to cause the image processing unit 22 to correct the signal values based on the luminance information for each pixel 48, the planar-light-source-device 50 is incapable of achieving any luminance exceeding its capacity. Therefore, if the correction is to be performed perfectly, the image processing unit 22 ends up adjusting the luminance uniformly to the darkest part of the planar-light-source-device 50, so that the resulting image might end up being displayed entirely darker (the power efficiency might be reduced). When the luminance is adjusted uniformly to the darkest part of the planar-light-source-device 50, the power consumption in the display device 10 might be increased. An alternative way to avoid such an increase in the power consumption is not performing the correction at all, but the area with the peak luminance near the light sources 56A, 56B, 56C, 56D, 56E, and 56F might be visible when no correction is performed at all. In the display device 10 according to the present embodiment, therefore, the luminance of areas with the peak luminance near the light sources 56A, 56B, 56C, 56D, 56E, and 56F is corrected, to minimize the area applied with correction, so that an increase in the power consumption is suppressed.

Figure 16:
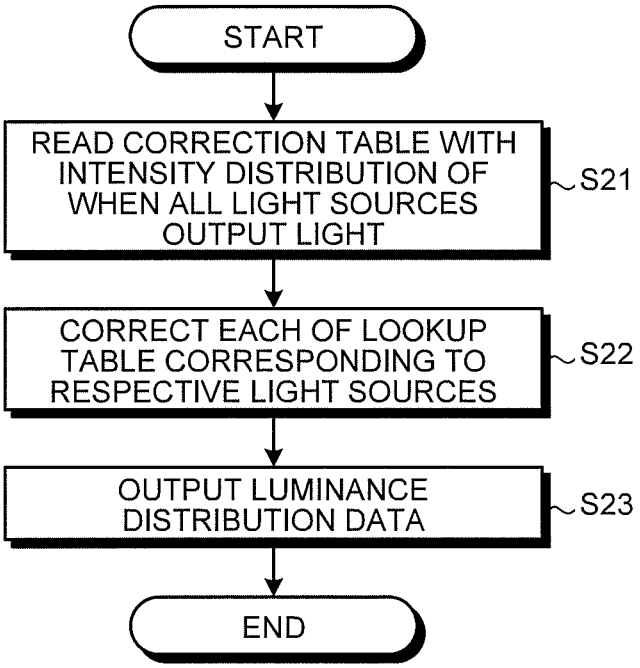
FIG. 16 is a flowchart for explaining a process of correcting uneven luminance in a second embodiment.
Figure 17:
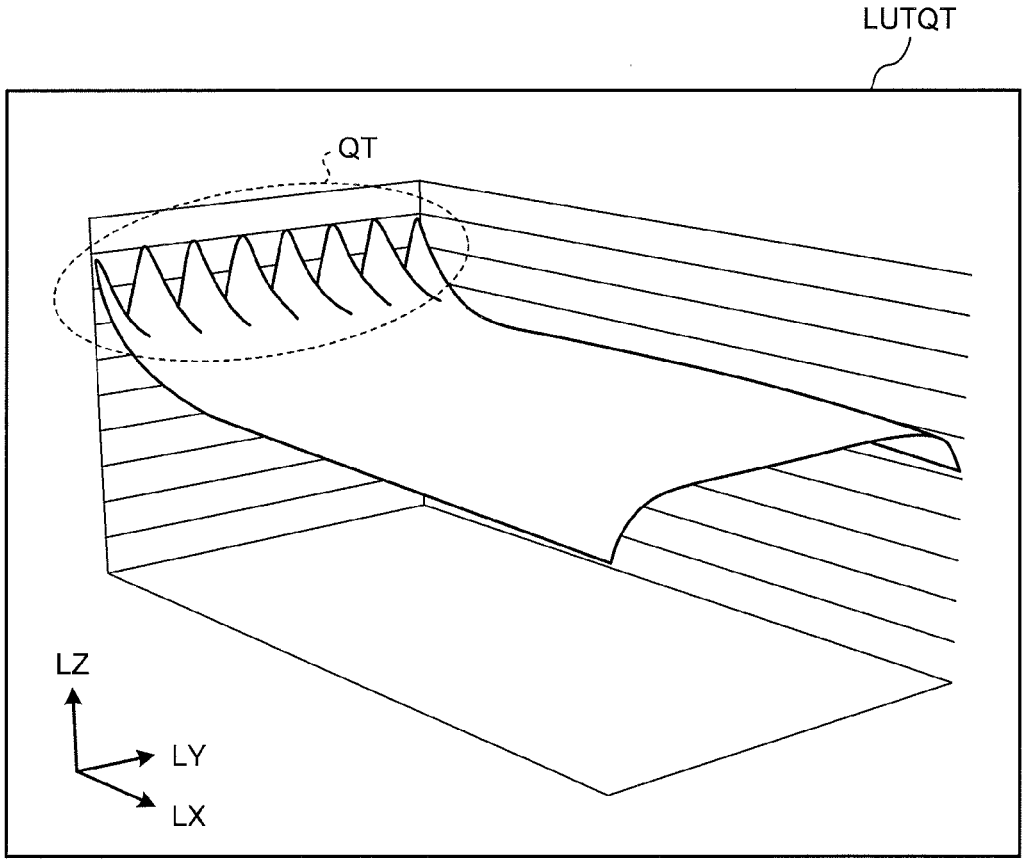
FIG. 17 is an explanatory diagram for explaining a light intensity distribution of the light that is incident on the light guide plate from the light sources and is emitted to the plane of the image display panel from the light guide plate when the light sources emit light by approximately the same quantity in the second embodiment.
Figure 18:
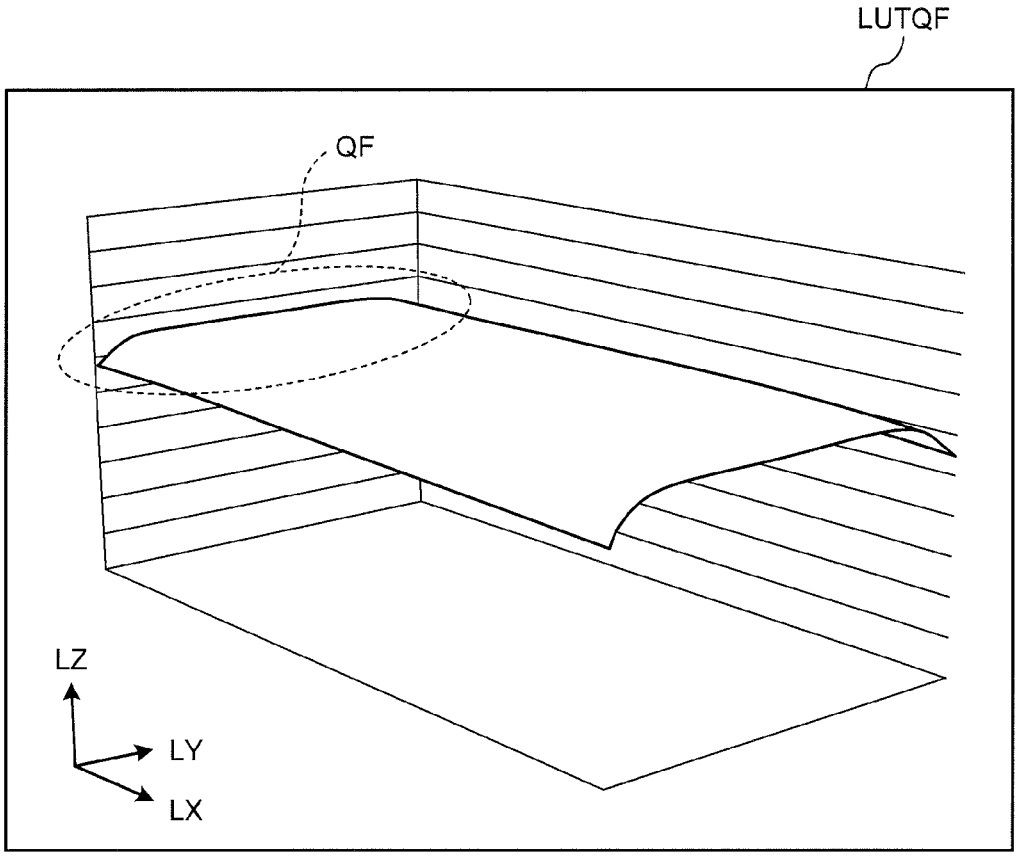
FIG. 18 is an explanatory diagram for explaining a correction table according to the second embodiment.
Figure 19:
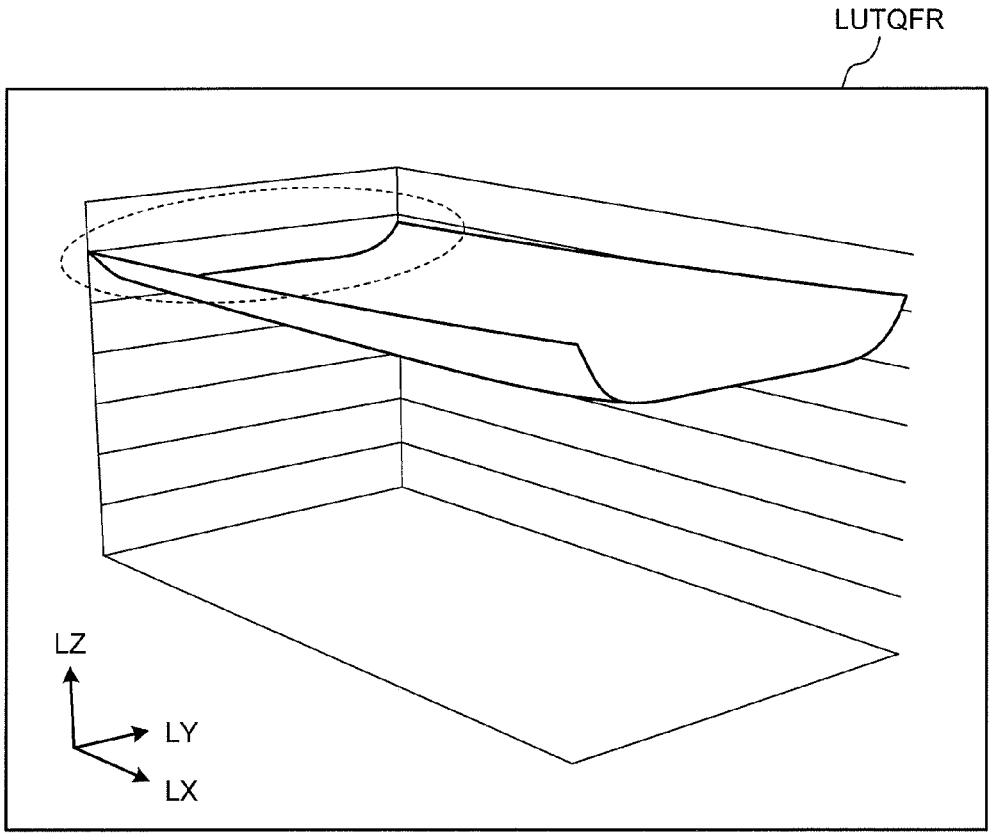
FIG. 19 is an explanatory diagram for explaining an inverse distribution represented in the correction table according to the second embodiment.
Figure 20:
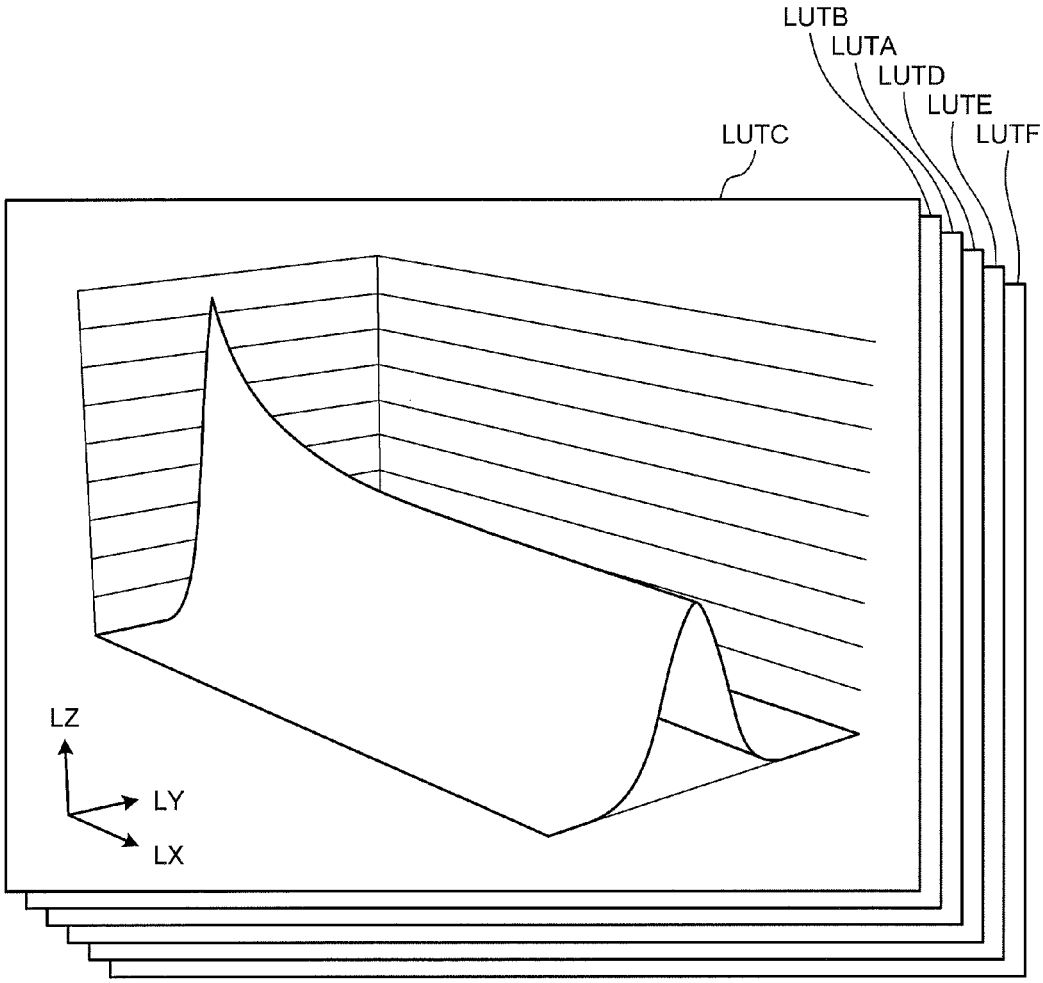
FIG. 20 is an explanatory diagram for explaining the lookup tables provided for the respective light sources in the second embodiment.
Figure 21:
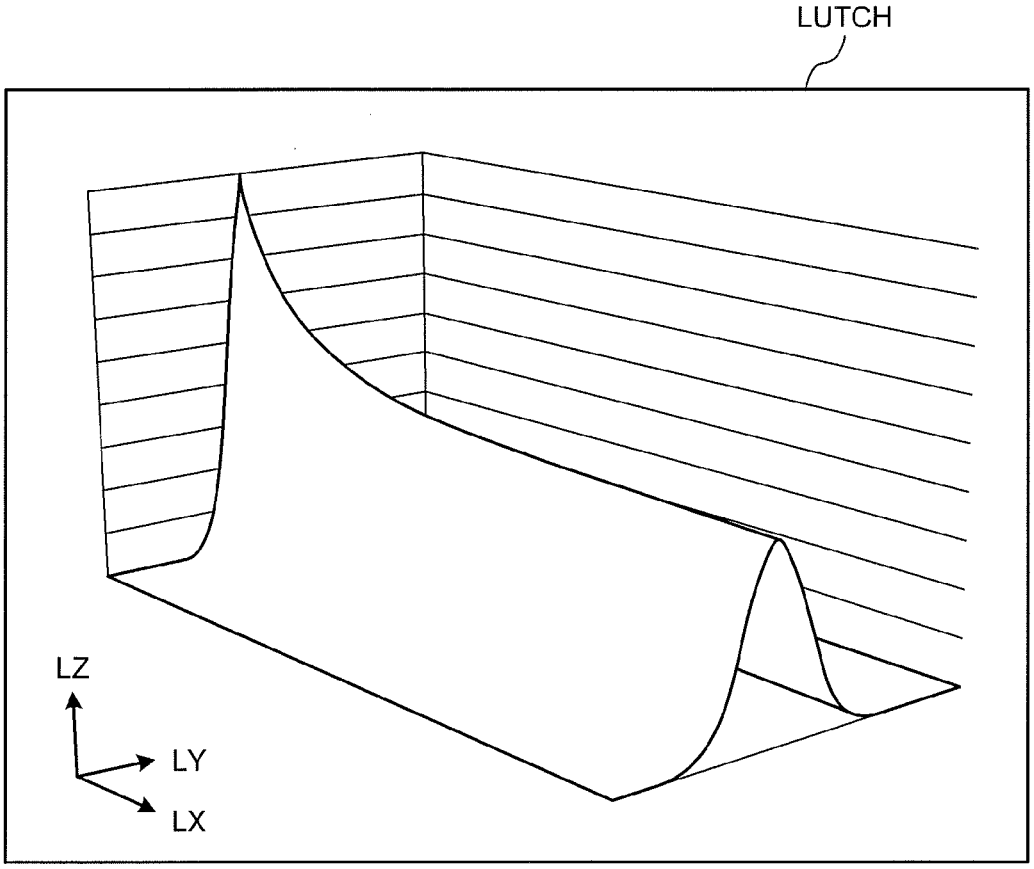
FIG. 21 is an explanatory diagram for explaining a corrected lookup table corresponding to a light source in the second embodiment.
Figure 22:
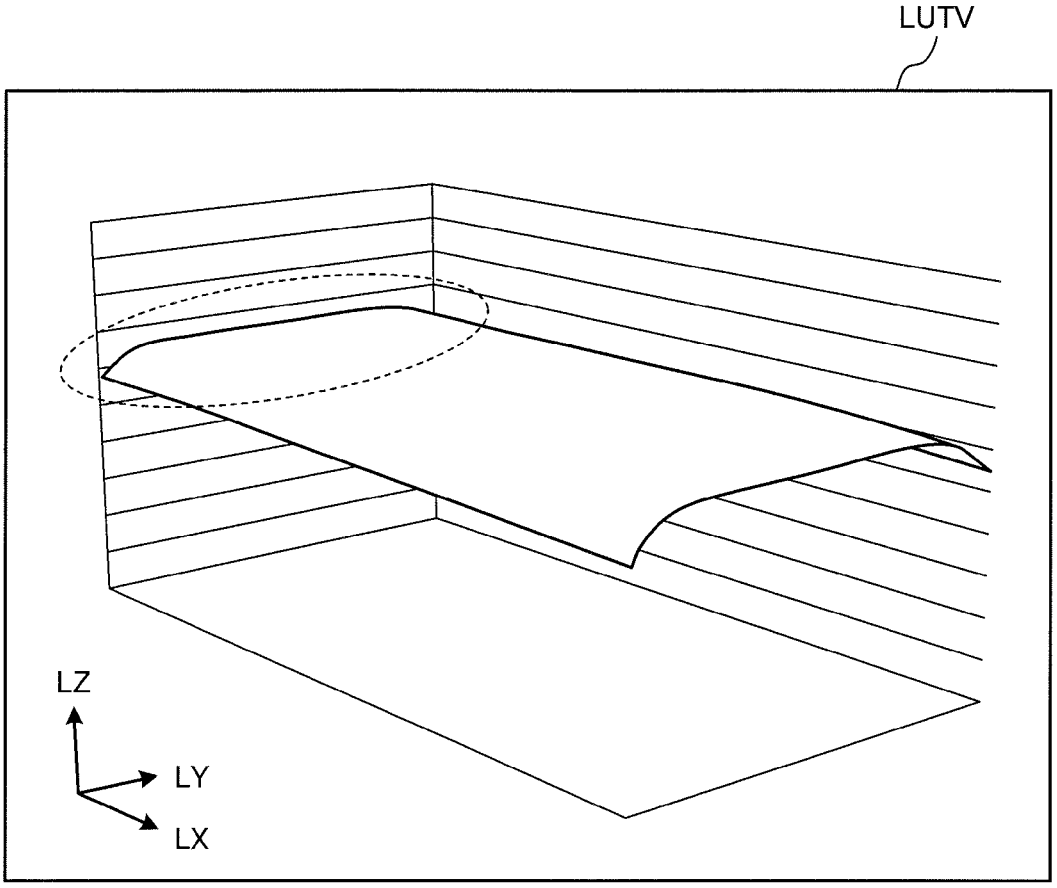
FIG. 22 is an explanatory diagram for explaining the luminance distribution in the image display panel according to the second embodiment.

FIG. 16 is a flowchart for explaining a process of correcting uneven luminance in the present embodiment. The light-source-drive-value-determining-unit 26 reads a correction table representing a light intensity distribution of when all of the light sources emit light (Step S21). FIG. 17 is an explanatory diagram for explaining a light intensity distribution of the light that is incident on the light guide plate from the light sources and is emitted to the plane of the image display panel from the light guide plate when the light sources emit light by approximately the same quantity in the present embodiment. FIG. 18 is an explanatory diagram for explaining a correction table according to the present embodiment. FIG. 19 is an explanatory diagram for explaining an inverse distribution represented in the correction table according to the present embodiment. FIG. 20 is an explanatory diagram for explaining the lookup tables provided for the respective light sources in the present embodiment. FIG. 21 is an explanatory diagram for explaining a corrected lookup table corresponding to a light source in the present embodiment. FIG. 22 is an explanatory diagram for explaining the luminance distribution in the image display panel according to the present embodiment.

In the display device according to the present embodiment, the uneven luminance is corrected using the lookup tables, examples of which are illustrated in FIG. 4 and FIG. 5, representing the luminance distributions of the respective light sources 56A, 56B, 56C, 56D, 56E, and 56F. When the uneven luminance is not corrected at all in such a configuration, the controller may completely flatten the luminance distribution represented in the lookup table resulting from superimposing all of the lookup tables LUTA, LUTB, LUTC, LUTD, LUTE, and LUTF corresponding to the respective light sources, and set the luminance to a desired level. If the luminance distribution is not corrected at all in the manner mentioned above, although the power consumption will not increase, observers may visually recognize the light as having the light intensity distribution of the light that is emitted to the plane of the image display panel from the light guide plate, as illustrated in FIG. 17, for example. In particular, bright spots where the luminance concentrates at peaks QT of the luminance near the light sources 56A, 56B, 56C, 56D, 56E, and 56F are visually recognized as luminance unevenness. The lookup table illustrated in FIG. 17 representing the light intensity distribution of the light that is incident on the light guide plate from all of the light sources and emitted to the plane of the image display panel from the light guide plate represents the light intensity distribution of when the light sources emit light by approximately the same quantity, and can be generated by superimposing all of the lookup tables LUTA, LUTB, LUTC, LUTD, LUTE, and LUTF corresponding to the respective light sources.

In the display device according to the present embodiment, the luminance is corrected mainly to remove the peak components QT that are the uneven luminance illustrated in FIG. 17. In other words, a correction is performed to acquire a lookup table LUTQF representing a light intensity distribution having corrected luminance QF in which the luminance of the area including the peak components QT is brought near the average of the luminance of the entire area. To begin with, the controller generates a luminance distribution of when all of the light sources emit light by approximately the same quantity, as illustrated in FIG. 17. The controller then performs date processing in such a manner that the luminance distribution in the area including the peaks QT of the luminance near the light sources 56A, 56B, 56C, 56D, 56E, and 56F is adjusted to approximately the same level as the average of the luminance components of the remaining area, thereby generating the lookup table LUTQF representing the luminance distribution illustrated in FIG. 18. The controller then calculates inverses of the light intensities represented in the lookup table LUTQF, thereby acquiring a correction table LUTQFR illustrated in FIG. 19. The correction table LUTQFR obtained by calculating the inverses is then multiplied to each of the lookup tables LUTA, LUTB, LUTC, LUTD, LUTE, and LUTF corresponding to the respective light sources illustrated in FIG. 20, to correct the luminance distribution represented thereby. A correction can be performed in such a manner that the luminance of the area including the peak components QT of the luminance near the light sources 56A, 56B, 56C, 56D, 56E, and 56F is mainly corrected, while the luminance of the remaining area is not corrected. In other words, as illustrated in FIG. 16, the light-source-drive-value-computing-unit 24 corrects each of the lookup tables LUTA, LUTB, LUTC, LUTD, LUTE, and LUTF corresponding to the respective light sources by multiplying the correction table LUTQFR to each of the lookup tables LUTA, LUTB, LUTC, LUTD, LUTE, and LUTF corresponding to the respective light sources illustrated in FIG. 20 or 11, to acquire the corrected lookup tables LUTAH, LUTBH, LUTCH, LUTDH, LUTEH, and LUTFH corresponding to the respective light sources (Step S22). In FIG. 21, the corrected lookup table LUTCH corresponding to the light source is provided as a representative example, but the corrected lookup tables LUTAH, LUTBH, LUTDH, LUTEH and LUTFH corresponding to the respective light sources may also be acquired in the same manner, by correcting each of the lookup tables LUTA, LUTB, LUTD, LUTE, and LUTF corresponding to the respective light sources by multiplying the correction table LUTQFR to the lookup table. In the corrected lookup tables LUTAH, LUTBH, LUTCH, LUTDH, LUTEH, and LUTFH corresponding to the respective light sources, the luminance is partially corrected near the light sources 56A, 56B, 56C, 56D, 56E, and 56F. In this manner, it is possible to output images corrected as intended, with no computational load for the correction.

The light-source-drive-value-computing-unit 24 refers to the corrected lookup tables LUTAH, LUTBH, LUTCH, LUTDH, LUTEH, and LUTFH corresponding to the respective light sources to compute the light quantity of each of the light sources 56A, 56B, 56C, 56D, 56E, and 56F by superimposing the corrected lookup tables LUTAH, LUTBH, LUTCH, LUTDH, LUTEH, and LUTFH corresponding to the respective light sources over one another in such a manner that a quantity of light emitted from the planar-light-source-device 50 approximates $(1/\alpha)$ times of a quantity of light emitted from the planar-light-source-device 50 of when an image not extended by a is displayed. For example, the (i, j)th representative luminance (where $1 \le i \le N$, $1 \le j \le M$) obtained by superimposing the corrected lookup tables LUTAH, LUTBH, LUTCH, LUTDH, LUTEH, and LUTFH corresponding to the respective light sources can be computed by Equation (11).

$$L_{(i,j)}T(i,\ j) = L_{(i,j)}\sum_{k=0}^{n}\{T_{k(i,j)} \times (I_c/\alpha_k)\} = \sum_{k=0}^{n}\{L_{(i,j)} \times T_{k(i,k)} \times (I_c/\alpha_k)\} \quad (11)$$

$L_{(i,j)}$: Correction table (inverse)

$L_{(i,j)}T_{k(i,j)}$: Value of corrected lookup table corresponding to each light source $I_c/\alpha_k$: Corresponding light source current In this manner, the light-source-drive-value-computing-unit 24 can replace the complex computations with simple reference to the corrected lookup tables LUTAH, LUTBH, LUTCH, LUTDH, LUTEH, and LUTFH corresponding to the respective light sources, so that the amount of computations can be reduced.

The light-source-drive-value-determining-unit 26 computes the luminance information for each pixel 48 through interpolation based on the light quantity of each of the light sources 56A, 56B, 56C, 56D, 56E, and 56F acquired at Step S13, and based on the corrected lookup tables LUTAH, LUTBH, LUTCH, LUTDH, LUTEH, and LUTFH corresponding to the respective light sources.

The light-source-drive-value-determining-unit 26 then sends the luminance information for each pixel 48 to the image processing unit 22. The image processing unit 22 corrects the input signal SRGB based on the luminance information for each pixel 48, and computes an output signal SRGBW for outputting a signal value $X_{1-(p,\ q)}$, a signal value $X_{2-(p,\ q)}$, a signal value $X_{3-(p,\ q)}$, and a signal value $X_{4-(p,\ q)}$ for the (p, q)th pixel 48 (Step S23). Based on the synchronizing signal STM, the image-display-panel-drive-unit 40 displays an image on the image display panel 30 for each frame, and the planar-light-source-device-control-unit 60 drives each of the light sources 56A, 56B, 56C, 56D, 56E, and 56F in the planar-light-source-device 50 independently. The image display panel 30 can then display images with the peak components suppressed in the luminance distribution, as in the luminance distribution LUTV illustrated in FIG. 22, while keeping the power consumption level low. In an alternative configuration, the light-source-drive-value-determining-unit 26 may not create the corrected lookup tables corresponding to the respective light sources through the correction process illustrated in the flowchart in FIG. 16. For example, the corrected lookup tables corresponding to the respective light sources created in advance may be used in place of the lookup tables for the respective light sources. In this manner, it is possible to output images corrected as intended, with no computational load for the correction.

Figure 23:
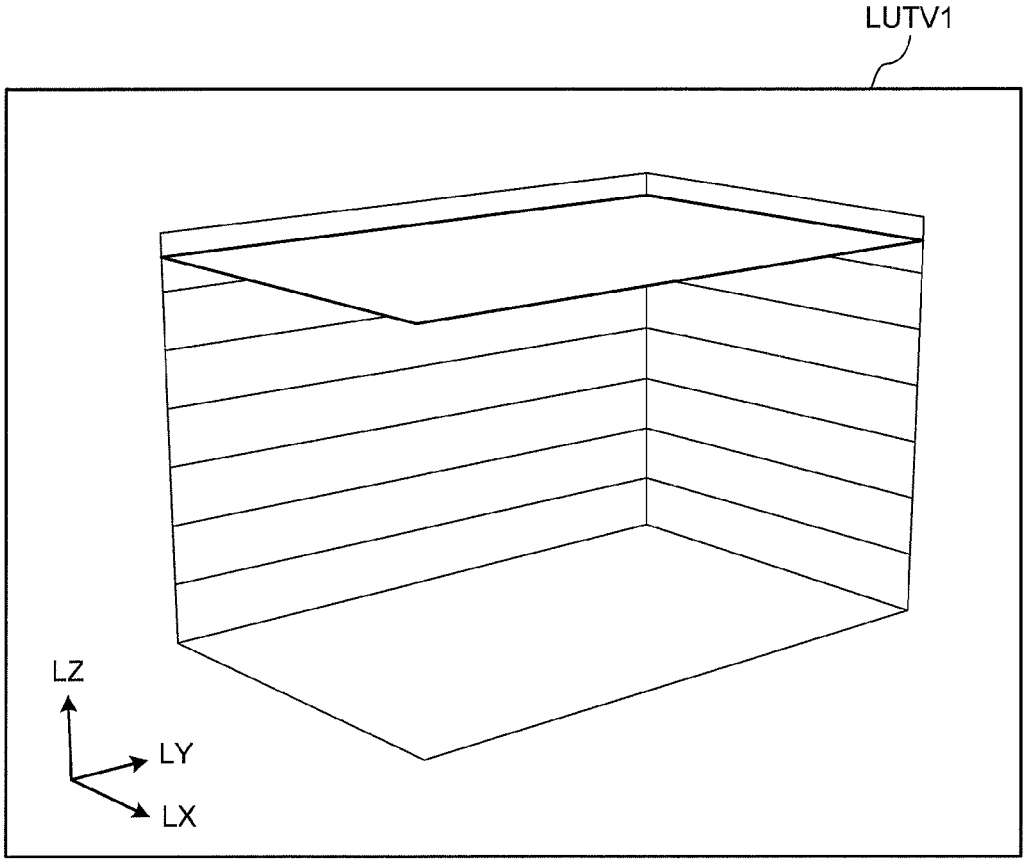
FIG. 23 is an explanatory diagram for explaining a luminance distribution in the image display panel according to a comparative example.

FIG. 23 is an explanatory diagram for explaining the luminance distribution in an image display panel according to a comparative example. When the luminance distribution is to be corrected as illustrated in FIG. 23, using the luminance distribution illustrated in FIG. 17 of when all of the light sources emit light, the uneven luminance can be corrected in the entire area. However, the planar-light-source-device 50 is incapable of achieving any luminance exceeding its capacity, as in the luminance distribution LUTV1 illustrated in FIG. 23. If the luminance correction is to be performed perfectly, the light-source-drive-value-determining-unit 26 ends up adjusting the luminance uniformly to the darkest part of the planar-light-source-device 50, so that the resulting image might end up being displayed entirely darker (the power efficiency might be reduced).

Figure 24:
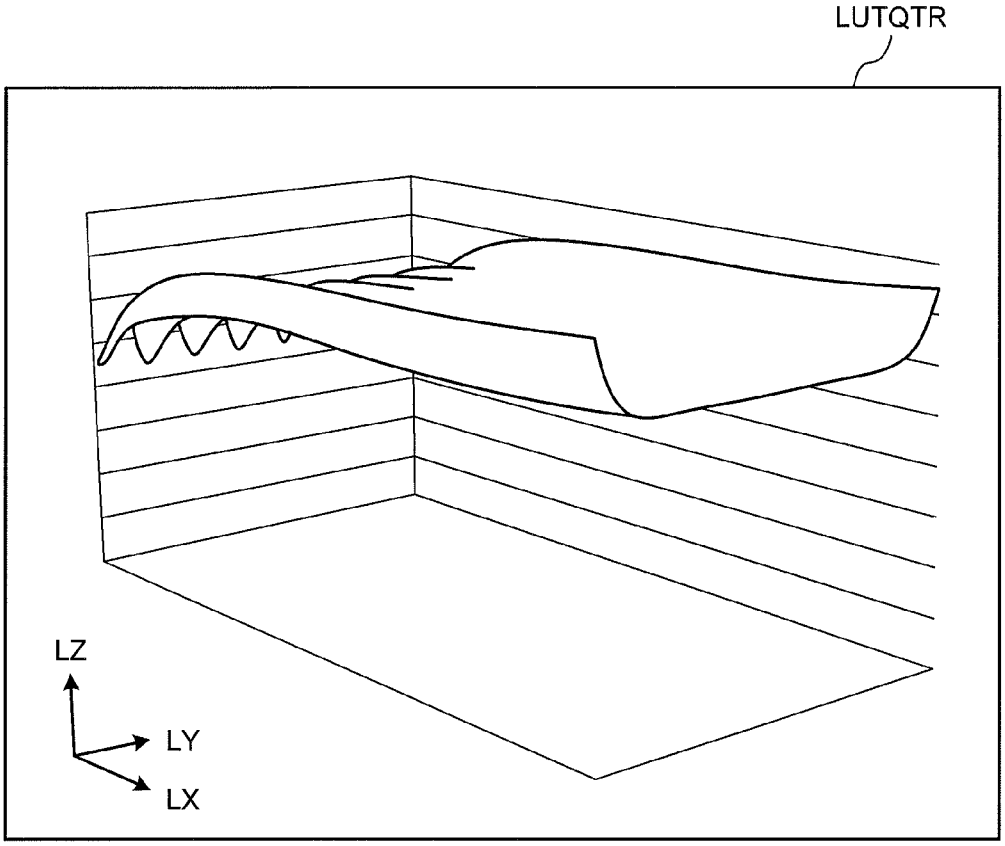
FIG. 24 is an explanatory diagram for explaining the inverse distribution illustrated in FIG. 17.
Figure 25:
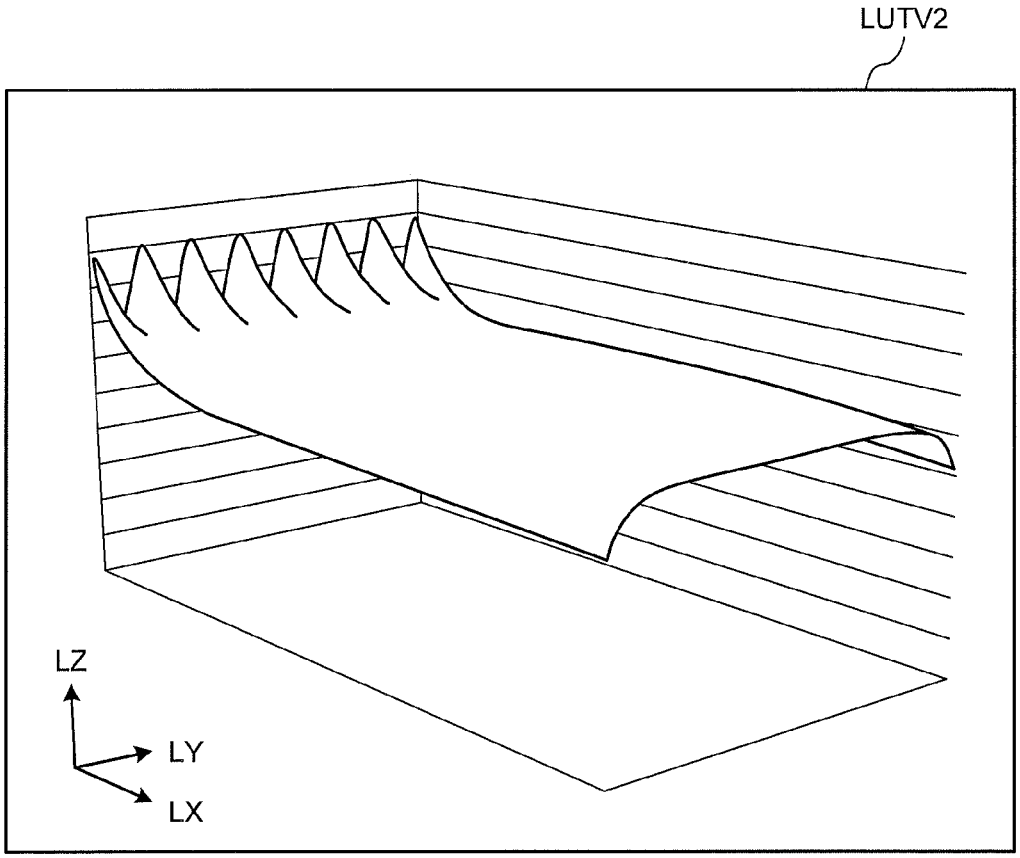
FIG. 25 is an explanatory diagram for explaining a luminance distribution in the image display panel according to the comparative example.

FIG. 24 is an explanatory diagram for explaining the inverse distribution illustrated in FIG. 17. FIG. 25 is an explanatory diagram for explaining a luminance distribution in the image display panel according to the comparative example. By calculating inverses of the light intensities represented in the lookup table LUTQT illustrated in FIG. 17, a correction table LUTQTR representing the inverse distribution illustrated in FIG. 24 is acquired. Even when the light-source-drive-value-computing-unit 24 multiplies the correction table LUTQTR to each of the lookup tables LUTA, LUTB, LUTC, LUTD, LUTE, and LUTF corresponding to the respective light sources illustrated in FIG. 20 or 11, the uneven luminance is not corrected, as indicated by the luminance distribution LUTV2 in FIG. 25, although the power consumption is reduced.

As explained above, the display device 10 stores therein the lookup tables LUTA, LUTB, LUTC, LUTD, LUTE, and LUTF corresponding to the respective light sources for the respective light sources, these lookup tables representing the information on light intensity distributions of the light that is incident on the light guide plate 54 from the respective light sources 56A, 56B, 56C, 56D, 56E, and 56F and is emitted to the plane of the image display panel 30 from the light guide plate 54. For the lookup tables LUTA, LUTB, LUTC, LUTD, LUTE, and LUTF corresponding to the respective light sources, the corrected lookup tables LUTAH, LUTBH, LUTCH, LUTDH, LUTEH, and LUTFH corresponding to the respective light sources are computed and stored in the light-source-data-storage-unit 25. Suppressed in the light intensity distributions represented in these corrected lookup tables are the peak components observed when all of the light sources emit light by approximately the same quantity. The display device 10 controls the light quantity of each of the light sources based on the corrected lookup tables LUTAH, LUTBH, LUTCH, LUTDH, LUTEH, and LUTFH corresponding to the respective light sources and the information on the image input signal SRGB. With the display device according to the present embodiment, the uneven luminance near the light sources can be corrected to improve the luminance distribution, without sacrificing the power consumption, the circuit scale, and the like.

APPLICATION EXAMPLES

Some application examples of the display device 10 explained in the present embodiment, and modifications will now be explained with reference to FIGS. 26 to 34. The present embodiment and the modifications will now be explained as the present embodiment. FIGS. 26 to 34 are diagrams each illustrating an example of an electronic apparatus to which the display device according to the present embodiment is applied. The display device 10 according to the present embodiment may be used in any electronic apparatus in any field, e.g., portable electronic apparatuses such as mobile phones and smartphones, television devices, digital cameras, laptop personal computers, video cameras, and any meter provided to a vehicle. In other words, the display device 10 according to the present embodiment can be applied to electronic apparatuses of all fields that display externally received video signals or internally generated video signals as images or video pictures. Such an electronic apparatus includes a controlling device that supplies video signals to the display device 10 and controls the display device 10.

Application Example 1

Figure 26:
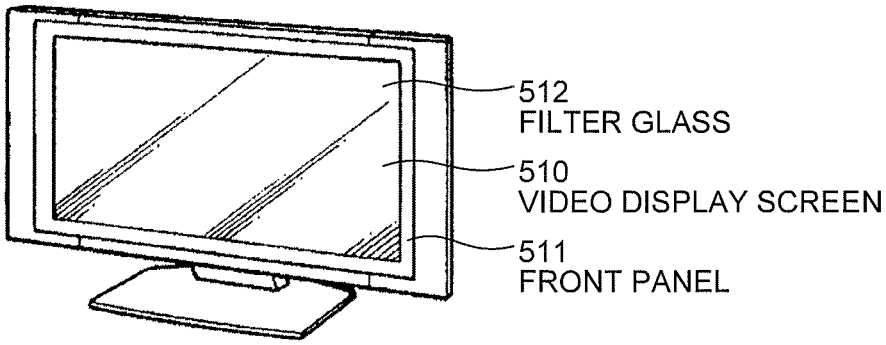
FIG. 26 is a diagram illustrating an example of an electronic apparatus to which the display device according to the embodiments is applied.

The electronic apparatus illustrated in FIG. 26 is a television device to which the display device 10 according to the present embodiment is applied. This television device includes a video display screen 510 having a front panel 511, and a filter glass 512. The display device 10 according to the present embodiment is used as the video display screen 510.

Application Example 2

Figure 27:
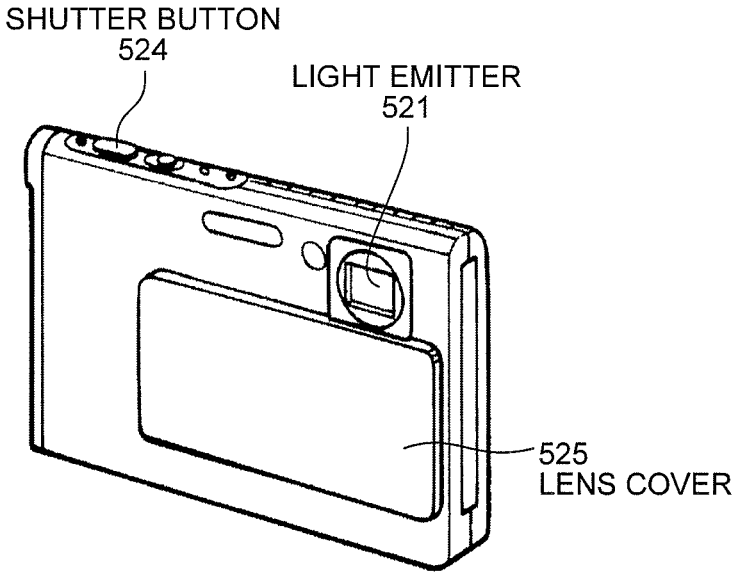
FIG. 27 is a diagram illustrating an example of an electronic apparatus to which the display device according to the embodiments is applied.
Figure 28:
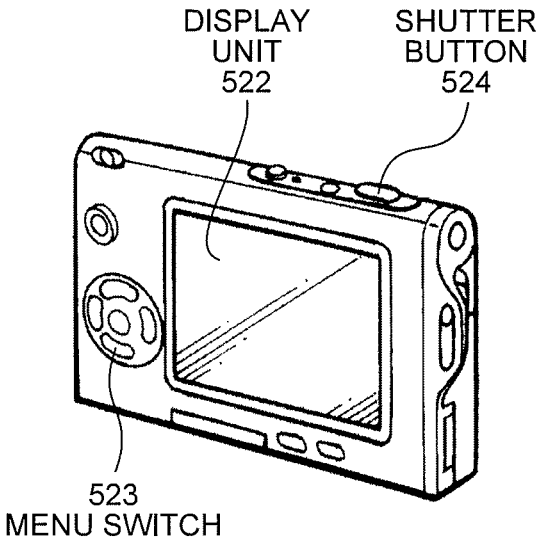
FIG. 28 is a diagram illustrating an example of an electronic apparatus to which the display device according to the embodiments is applied.

The electronic apparatus illustrated in FIGS. 27 and 28 is a digital camera using the display device 10 according to the present embodiment. This digital camera includes a light emitter 521 as a flash, a display unit 522, a menu switch 523, and a shutter button 524. The display device 10 according to the present embodiment is used as the display unit 522. This digital camera has a lens cover 525, as illustrated in FIG. 27, and a photographic lens appears when the lens cover 525 is slid away. The digital camera can take digital photographs by imaging the light incident from the photographic lens.

Application Example 3

Figure 29:
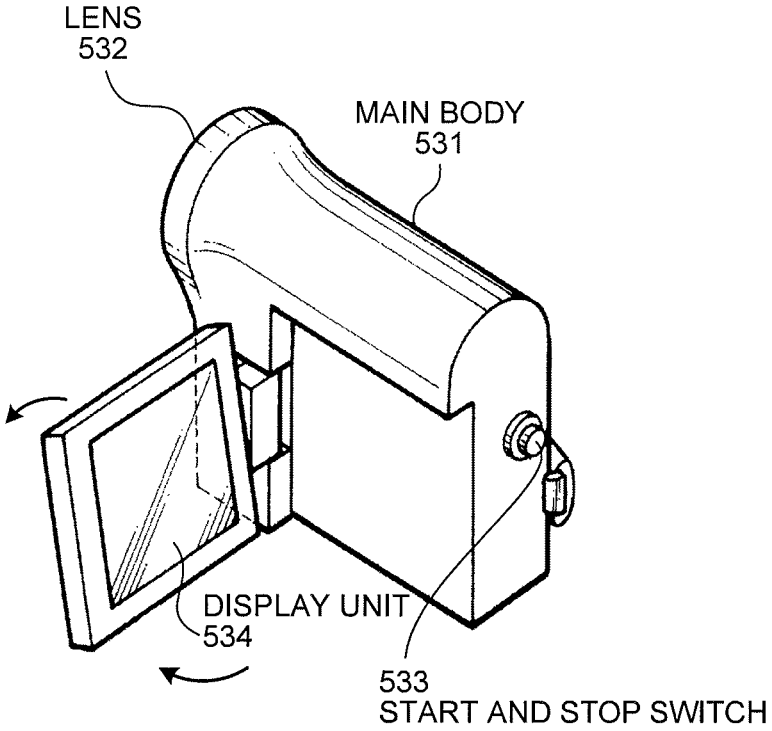
FIG. 29 is a diagram illustrating an example of an electronic apparatus to which the display device according to the embodiments is applied.

The electronic apparatus illustrated in FIG. 29 is a video camera using the display device 10 according to the present embodiment, and FIG. 28 illustrates an external view of the video camera. This video camera includes a main body 531, a subject photographic lens 532 provided on the front side of the main body 531, a shooting start and stop switch 533, and a display unit 534. The display device 10 according to the present embodiment is used as the display unit 534.

Application Example 4

Figure 30:
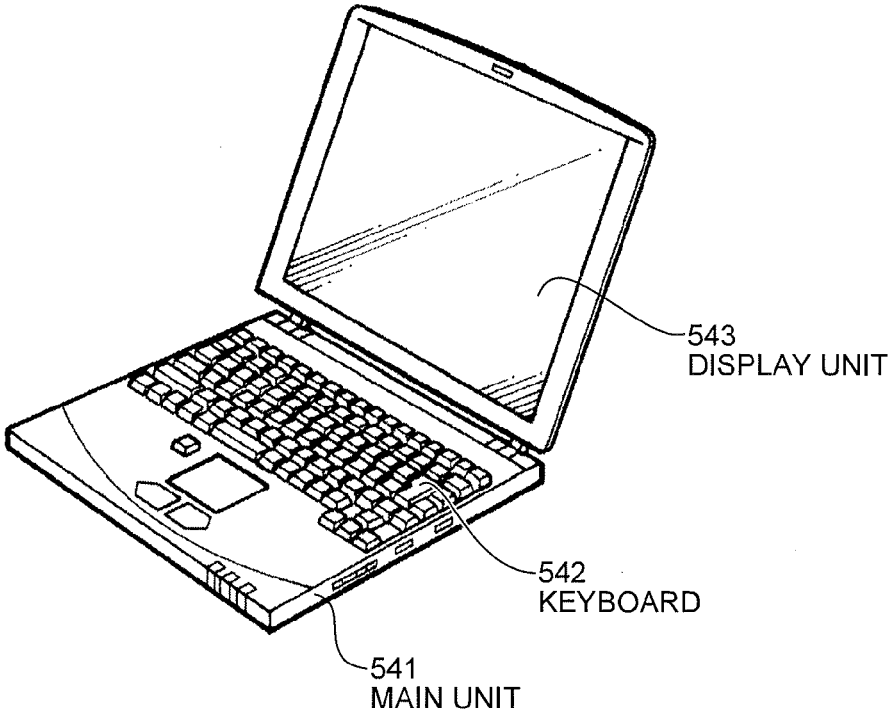
FIG. 30 is a diagram illustrating an example of an electronic apparatus to which the display device according to the embodiments is applied.

The electronic apparatus illustrated in FIG. 30 is a laptop personal computer using the display device 10 according to the present embodiment. The laptop personal computer includes a main unit 541, a keyboard 542 for making operations such as entering characters, and a display unit 543 for displaying images. The display device 10 according to the present embodiment is used as the display unit 543.

Application Example 5

Figure 31:
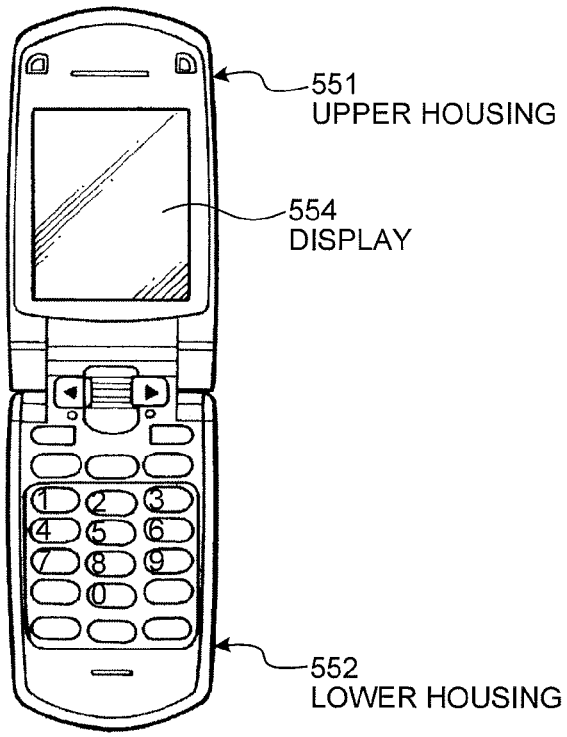
FIG. 31 is a diagram illustrating an example of an electronic apparatus to which the display device according to the embodiments is applied.
Figure 32:
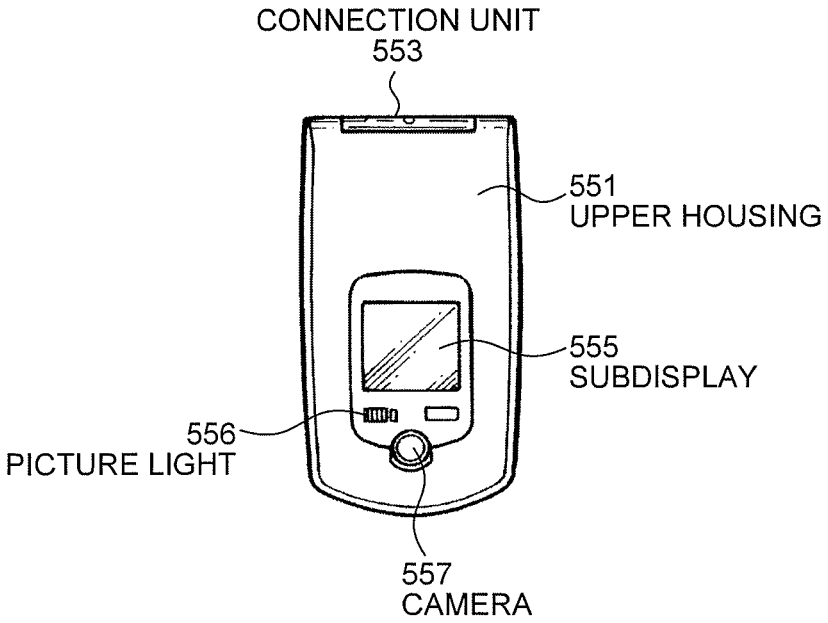
FIG. 32 is a diagram illustrating an example of an electronic apparatus to which the display device according to the embodiments is applied.

The electronic apparatus illustrated in FIGS. 31 and 32 is a mobile phone to which the display device 10 is applied. FIG. 31 is a front view of the mobile phone in the opened state. FIG. 32 is a front view of the mobile phone in the closed state. For example, this mobile phone is composed of an upper housing 551 and a lower housing 552 connected to each other by a connection unit (hinge unit) 553, and includes a display 554, a subdisplay 555, a picture light 556, and a camera 557. The display device 10 serves as the display 554. The display 554 of the mobile phone may have the function of detecting touch operations, in addition to the function of displaying images.

Application Example 6

Figure 33:
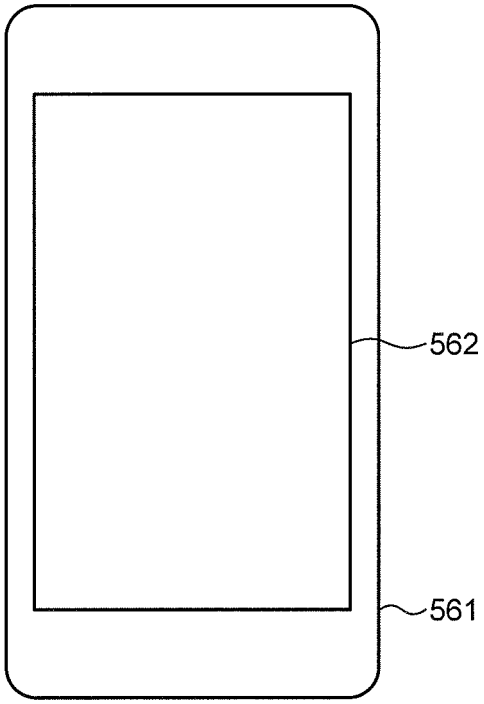
FIG. 33 is a diagram illustrating an example of an electronic apparatus to which the display device according to the embodiments is applied.

The electronic apparatus illustrated in FIG. 33 is a mobile information terminal that operates as a portable computer, a multifunctional mobile phone, a portable computer with voice call capability, or a portable computer with communication capability, and that is also called a smartphone or a tablet computer. Examples of the mobile information terminal include, but are not limited to, a display unit 562 on a surface of a housing 561. The display device 10 according to the present embodiment serves as the display unit 562.

Application Example 7

Figure 34:
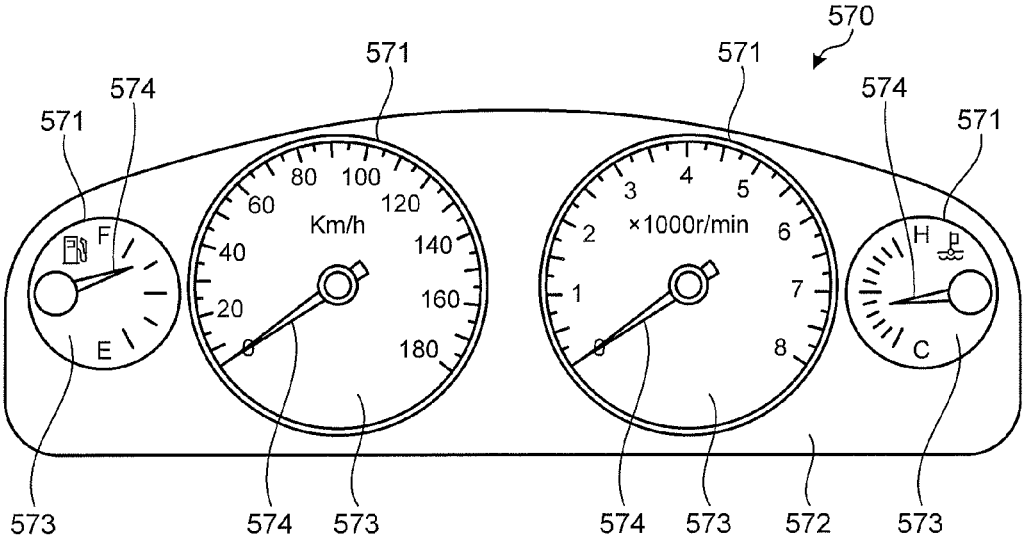
FIG. 34 is a diagram illustrating an example of an electronic apparatus to which the display device according to the embodiments is applied.

FIG. 34 is a schematic of a general structure of a meter unit according to the present embodiment. The electronic apparatus illustrated in FIG. 34 is a meter unit mounted on a vehicle. The meter unit (electronic apparatus) 570 illustrated in FIG. 34 has a plurality of display devices 571 each of which is the display device 10 according to the present embodiment, serving as a fuel meter, a coolant temperature meter, a speed meter, a tachometer, or the like. These display devices 571 are covered by one face panel 572.

Each of the display devices 571 illustrated in FIG. 34 is a combination of a panel 573 that is a display unit and a movement mechanism that is an analog indicator. The movement mechanism includes a motor serving as a driving unit and a pointer 574 rotated by the motor. As illustrated in FIG. 34, the display device 571 can display a scale, indicators, and the like on the display surface of the panel 573, and the pointer 574 of the movement mechanism can be rotated on the display surface of the panel 573.

In the example illustrated in FIG. 34, the display device 571 is provided in plurality on the face panel 572 provided in singularity, but implementations are not limited thereto. For example, the display device 571 may be provided in singularity in the area surrounded by the face panel 572, and the fuel meter, the coolant temperature meter, the speed meter, the tachometer, and the like may be displayed in the display device 571.

What is claimed is:

1. A display device comprising:

an image display panel;

a planar light source including a light guide plate and an edge-lit light source, the light guide plate illuminating the image display panel from a back side, the edge-lit light source including a plurality of light sources arranged in a first direction facing a plane of incidence that is at least one side surface of the light guide plate; and a controller that controls luminance of each of the plurality of light sources independently, wherein, the controller stores therein lookup tables corresponding to the plurality of light sources, each of the lookup tables indicating light intensity distribution information that is information on a distribution of light intensity values of light for respective divided areas specified by the first direction and a second direction that is perpendicular to the first direction, is the light being incident on the light guide plate from the plurality of light sources and being emitted to a plane of the image display panel from the light guide plate, and the controller controls a light quantity of each of the plurality of light sources based on information on an input signal of an image and luminance information obtained by superimposing the lookup tables.

2. The display device according to claim 1, wherein the image display panel further includes pixels, and wherein the controller performs interpolation to acquire luminance information of the pixels of the image display panel based on information on the light quantity of each of the plurality of light sources and, the information in the lookup tables.

3. The display device according to claim 1, wherein luminance information of pixels of the image display panel is acquired by performing polynomial interpolation in the first direction, and performing linear interpolation in the second direction.

4. The display device according to claim 1, wherein the controller stores therein the lookup tables for respective light sources of the plurality of light sources positioned on one side of a center line indicating a center of the light guide plate in the first direction, and the controller reads information in the lookup tables corresponding to the respective light sources, as information on light intensity distributions of light that is emitted to the plane of the image display panel from second respective light sources of the plurality of light sources positioned on the other side of the center line, the respective light sources being line symmetric to the second respective light sources with respect to the center line.

5. The display device according to claim 1, wherein the planar light source uses the edge-lit light source as a first edge-lit light source, the at least one side surface of the light guide plate as a first plane of incidence, and an other side surface facing the one side surface of the light guide plate as a second plane of incidence, and includes a second edge-lit light source including a second plurality of light sources aligned at a position facing the second plane of incidence, the controller stores therein the lookup tables for the first edge-lit light source, and the controller reads information in the lookup tables corresponding to the plurality of light sources positioned on the one side surface facing the other side surface, as information on light intensity distributions of light that is emitted to the plane of the image display panel from respective light sources of the second plurality of light sources in the second edge-lit light source.

6. The display device according to claim 1, wherein the planar light source uses the edge-lit light source as a first edge-lit light source, the at least one side surface of the light guide plate as a first plane of incidence, and an other side surface facing the one side surface of the light guide plate as a second plane of incidence, and includes a second edge-lit light source including a second plurality of light sources aligned at a position facing the second plane of incidence, and the controller stores therein the lookup tables for respective light sources of the plurality of light sources positioned on one side of a first center line indicating a center of the light guide plate in the first direction, the controller reads information in the lookup tables corresponding to the respective light sources of the plurality of light sources, as information on first light intensity distributions of light that is emitted to the plane of the image display panel from second respective light sources of the plurality of light sources positioned on the other side of the first center line, the respective light sources being line symmetric to the second respective light sources with respect to the first center line, the controller reads information in the lookup tables corresponding to the respective light sources of the plurality of light sources, as information on second light intensity distributions of light that is emitted to the plane of the image display panel from respective light sources of the second edge-lit light source positioned on one side of the first center line, the respective light sources of the plurality of light sources being line symmetric to the respective light sources of the second edge-lit light source with respect to a second center line indicating a center between the one side surface and the other side surface, and the controller reads information in the lookup tables corresponding to the respective light sources of the plurality of light sources, as information on third light intensity distributions of light that is emitted to the plane of the image display panel from the second plurality of light sources of the second edge-lit light source positioned on the other side of the first center line, the respective light sources being point symmetric to the second plurality of light sources with respect to a center point at which the second center line intersects with the first center line.

7. The display device according to claim 2, wherein the controller corrects the input signal of the image based on the luminance information of the pixels of the image display panel before the image is displayed on the image display panel.

8. The display device according to claim 1, wherein the image display panel further includes pixels arranged in a matrix, and wherein each of the pixels includes a first sub-pixel for displaying a first color, a second sub-pixel for displaying a second color, a third sub-pixel for displaying a third color, and a fourth sub-pixel for displaying a fourth color.

9. The display device according to claim 1, wherein the controller corrects at least one of the lookup tables based on an amount of misalignment of the plurality of light sources with respect to the light guide plate.

10. The display device according to claim 1, wherein the controller stores therein, for respective lookup tables corresponding to respective light sources of the plurality of light sources and storing therein information on respective light intensity distributions of light that is incident on the light guide plate from the respective light sources and is emitted to the plane of the image display panel from the light guide plate, corrected lookup tables that correspond to the respective light sources of the plurality of light sources and in which peak components are suppressed in the respective light intensity distributions, the peak components being observed when all of the plurality of light sources emit light by approximately a same quantity, and the controller controls the light quantity of each of the plurality of light sources based on the corrected lookup tables corresponding to the respective light sources of the plurality of light sources and the information on the input signal of the image.

11. The display device according to claim 10, wherein the controller acquires the corrected lookup tables that correspond to the respective light sources by multiplying a correction table that is obtained by calculating inverses of the information on the light intensity distribution in such a manner that the peak components are partially included, to each of the respective lookup tables corresponding to the respective light sources.

12. The display device according to claim 10, wherein the controller performs interpolation to acquire luminance information of pixels of the image display panel based on information on the light quantity of each of the plurality of light sources and information in the corrected lookup tables that correspond to the respective light sources.

13. The display device according to claim 10, wherein luminance information of pixels of the image display panel is acquired by performing polynomial interpolation in the first direction, and performing linear interpolation in the second direction.

14. The display device according to claim 12, wherein the luminance information of the pixels of the image display panel is stored for one side of the image display panel with respect to a center line in the first direction, and the luminance information is used for the other side that is line symmetric to the one side with respect to the center line.

15. The display device according to claim 12, wherein the controller corrects the input signal of the image based on the luminance information of the pixels of the image display panel before the image is displayed on the image display panel.

16. The display device according to claim 10, wherein the image display panel further includes pixels arranged in a matrix, and wherein each of the pixels includes a first sub-pixel for displaying a first color, a second sub-pixel for displaying a second color, a third sub-pixel for displaying a third color, and a fourth sub-pixel for displaying a fourth color.

17. An electronic apparatus comprising:

a display device having an image display panel;

a planar light source including a light guide plate and an edge-lit light source, the light guide plate illuminating the image display panel from a back side, the edge-lit light source including a plurality of light sources arranged in a first direction facing a plane of incidence that is at least one side surface of the light guide plate; and a controller that controls luminance of each of the plurality of light sources independently, wherein, the controller stores therein, as lookup tables corresponding to for the plurality of light sources, each of the lookup tables indicating light intensity distribution information that is information on a distribution of light intensity values distributions of light for respective divided areas specified by the first direction and a second direction that is perpendicular to the first direction, that is the light being incident on the light guide plate from the plurality of light sources and being and is emitted to a plane of the image display panel from the light guide plate, and the controller controls a light quantity of each of the plurality of light sources based on information on an input signal of an image, and on luminance information obtained by superimposing the lookup tables.

18. A method for driving a display device that comprises an image display panel and a planar light source including a light guide plate and an edge-lit light source, the light guide plate illuminating the image display panel from a back side, the edge-lit light source including a plurality of light sources arranged in a first direction facing a plane of incidence that is at least one side surface of the light guide plate, the method comprising:

detecting an input signal of an image;

analyzing the image; and computing a light quantity of each of the plurality of light sources based on a result of the analyzing the image, the input signal of the image, and luminance information obtained by superimposing lookup tables corresponding to the plurality of light sources, the lookup tables each indicating light intensity distribution information that is information on a distribution of light intensity values of light for respective divided areas specified by the first direction and a second direction that is perpendicular to the first direction, the light being incident on the light guide plate from the plurality of light sources and being emitted to a plane of the image display panel from the light guide plate.

19. A method for driving a display device that comprises an image display panel and a planar light source including a light guide plate and an edge-lit light source, the light guide plate illuminating the image display panel from a back side, the edge-lit light source including a plurality of light sources arranged facing a plane of incidence that is at least one side surface of the light guide plate, the method comprising:

detecting an input signal of an image;

analyzing the image;

computing a light quantity of each of the plurality of light sources based on a result of the analyzing the image, and based on corrected lookup tables that correspond to respective light sources of the plurality of light sources and in which peak components are suppressed, the corrected lookup tables being lookup tables corresponding to the respective light sources and storing therein information on light intensity distributions of light that is incident on the light guide plate from the respective light sources and is emitted to a plane of the image display panel from the light guide plate, and the peak components being observed when all of the plurality of light sources emit light by approximately a same quantity.

* * * * *